US008628262B2

(12) United States Patent
Bouix et al.

(10) Patent No.: US 8,628,262 B2
(45) Date of Patent: Jan. 14, 2014

(54) HEATED MASCARA APPLICATOR AND SUITABLE COMPOSITIONS

(75) Inventors: Herve F. Bouix, New York, NY (US); Stephen van Beek Faletti, Brooklyn, NY (US); Christophe Jacob, Rouen (FR); Rodney J. Duffin, Cedar Creek, TX (US); Peter Murphy, Hunt Valley, MD (US)

(73) Assignee: ELC Management, LLC, New York, NY (US)

( * ) Notice: Subject to any disclaimer, the term of this patent is extended or adjusted under 35 U.S.C. 154(b) by 0 days.

(21) Appl. No.: 13/593,715

(22) Filed: Aug. 24, 2012

(65) Prior Publication Data

US 2012/0321367 A1 Dec. 20, 2012

Related U.S. Application Data

(63) Continuation of application No. 12/732,835, filed on Mar. 26, 2010, now Pat. No. 8,308,383.

(51) Int. Cl.
*A46B 11/08* (2006.01)

(52) U.S. Cl.
USPC ..... 401/1; 401/126; 132/218

(58) Field of Classification Search
USPC ..... 401/1, 2, 126, 128–130, 121–122; 132/218
See application file for complete search history.

(56) References Cited

U.S. PATENT DOCUMENTS

| | | | |
|---|---|---|---|
| 2,488,591 | A | 11/1949 | Fevas |
| 3,518,410 | A | 6/1970 | Dillarstone |
| 4,067,480 | A | 1/1978 | Gasser |
| 4,274,588 | A | 6/1981 | Schwob |
| 4,291,685 | A | 9/1981 | Taelman |
| 4,329,567 | A | 5/1982 | Kunz et al. |
| 4,465,073 | A | 8/1984 | Schwob |
| 4,538,630 | A | 9/1985 | Henderson |
| 4,733,784 | A | 3/1988 | Bennett |
| 4,889,440 | A | 12/1989 | Shano |
| 5,096,319 | A | 3/1992 | Gueret |

(Continued)

FOREIGN PATENT DOCUMENTS

| | | |
|---|---|---|
| DE | 19839940 | 3/2000 |
| EP | 1563760 | 8/2005 |

(Continued)

OTHER PUBLICATIONS

PCT International Search Report; International Application No. PCT/US2012/036179; Completion Date: Nov. 22, 2012; Date of Mailing: Nov. 23, 2012.

(Continued)

*Primary Examiner* — David Walczak
*Assistant Examiner* — Jennifer C Chiang
(74) *Attorney, Agent, or Firm* — Peter Giancana

(57) ABSTRACT

A handheld mascara applicator comprising an applicator head, a source of electric current, and a heat generating portion that is effective to heat a quantity of mascara located on the applicator head, from an ambient temperature to a product application temperature, in 25 seconds or less, or that is effective to raise the temperature of the outer surface of the applicator head from an ambient temperature to about 55° C. or more, in 25 seconds or less. Systems for applying various types of mascara compositions are also disclosed.

44 Claims, 6 Drawing Sheets

(56) References Cited

U.S. PATENT DOCUMENTS

| | | | | |
|---|---|---|---|---|
| 5,395,175 | A | 3/1995 | Bontoux et al. | |
| 5,513,771 | A | 5/1996 | Cote | |
| 5,556,468 | A | 9/1996 | Legrain et al. | |
| 5,775,344 | A | 7/1998 | Clay | |
| 5,851,079 | A | 12/1998 | Horstman et al. | |
| 5,853,010 | A | 12/1998 | Suh | |
| 5,911,226 | A | 6/1999 | Vecchiola et al. | |
| 6,009,884 | A | 1/2000 | Suh | |
| 6,454,127 | B1 | 9/2002 | Suomela et al. | |
| 6,508,603 | B1 | 1/2003 | Vasas | |
| 6,911,010 | B2 | 6/2005 | Dirks et al. | |
| 7,083,347 | B2 | 8/2006 | Marcotte et al. | |
| 7,086,861 | B2 | 8/2006 | Pitz et al. | |
| 7,090,420 | B2 | 8/2006 | De La Poterie et al. | |
| 7,108,438 | B2 | 9/2006 | Fontaine | |
| 7,227,108 | B2 | 6/2007 | Clothier et al. | |
| 7,322,366 | B2 | 1/2008 | Cho | |
| 7,448,814 | B2 | 11/2008 | Bouix | |
| 7,465,114 | B2 | 12/2008 | Kress et al. | |
| 7,661,562 | B2 | 2/2010 | Tyrrell et al. | |
| 7,669,605 | B2 | 3/2010 | Cho | |
| 7,753,609 | B2 * | 7/2010 | Bouix et al. | 401/129 |
| 7,909,044 | B2 * | 3/2011 | Tranchant et al. | 132/218 |
| 7,950,863 | B2 * | 5/2011 | Bouix et al. | 401/129 |
| 7,980,776 | B2 * | 7/2011 | Cho | 401/1 |
| 2004/0096258 | A1 | 5/2004 | Kim | |
| 2004/0247367 | A1 | 12/2004 | Fontaine | |
| 2005/0013838 | A1 * | 1/2005 | De La Poterie | 424/401 |
| 2005/0031656 | A1 | 2/2005 | Pays et al. | |
| 2005/0244209 | A1 | 11/2005 | Gueret | |
| 2005/0258172 | A1 | 11/2005 | Gueret | |
| 2006/0032512 | A1 | 2/2006 | Kress et al. | |
| 2006/0246118 | A1 | 11/2006 | Gueret | |
| 2006/0251686 | A1 | 11/2006 | Gueret | |
| 2007/0206986 | A1 | 9/2007 | Gueret | |
| 2008/0273911 | A1 | 11/2008 | Gueret | |
| 2009/0020133 | A1 | 1/2009 | Gueret | |
| 2010/0043817 | A1 * | 2/2010 | Haan | 132/211 |
| 2010/0054841 | A1 | 3/2010 | Cho | |
| 2010/0086507 | A1 | 4/2010 | Gueret | |
| 2011/0076085 | A1 * | 3/2011 | Jollet et al. | 401/1 |
| 2011/0123248 | A1 | 5/2011 | Kim | |
| 2012/0009002 | A1 * | 1/2012 | Lo et al. | 401/6 |

FOREIGN PATENT DOCUMENTS

| | | |
|---|---|---|
| FR | 2891394 | 3/2007 |
| GB | 2174896 | 11/1986 |
| KR | 10-2007-0098410 | 10/2007 |
| WO | WO 2007/114551 | 10/2007 |

OTHER PUBLICATIONS

PCT Written Opinion of the International Searching Authority; International Application No. PCT/US2012/036179; Completion Date: Nov. 22, 2012; Mailing Date: Nov. 23, 2012.

International Search Report mailed Mar. 8, 2008, of PCT/US07/69759.

Written Opinion of the Isa dated Mar. 8, 2008, of PCT/US07/69759.

Related Application: Bouix and Jacob, " Heated Mascara Applicator and Suitable Compositions." U.S. Appl. No. 11/422,729, filed Jun 7, 2006.

Related Application: Bouix and Jacob, "Cosmetic Applicators Containing Heating Elements," U.S. Appl. No. 12/730,789, filed Mar. 24, 2010.

Related Application: Bouix and Jacob, "Heated Mascara Applicator and Suitable Compositions," U.S. Appl. No. 12/732,835, filed Mar. 26, 2010.

Related Application: Bouix, et al., "Reuseable Pump Dispenser for Heated Personal Care Compositions," U.S. Appl. No. 12/948,840, filed Nov. 18, 2010.

Related Application: Bouix, et al., Bouix, et al., "Capacitor Powered Personal Care Devices," U.S. Appl. No. 13/100,806, filed May 4, 2011.

Minco, Thermofoil Heaters (on-line), 2005 (Retrieved on Mar. 22, 2006). Retrieved from the Internet: URL: http://www.minco.com/products/heaters.aspx.

Related Application: Bouix, et al., "A System for Sampling a Heated Product." U.S. Appl. No. 12/980,526, filed Dec. 29, 2010.

* cited by examiner

HEATED MASCARA APPLICATOR AND SUITABLE COMPOSITIONS

This application is a continuation of U.S. Ser. No. 12/732,835, filed Mar. 26, 2010 now U.S. Pat. No. 8,308,383.

FIELD OF THE INVENTION

The present invention pertains to product applicators that heat a portion of product as it is being dispensed from a container and/or as it is being applied to a surface. More specifically, the present invention is concerned with handheld mascara applicators that are physically separate from a product reservoir during product application.

BACKGROUND OF THE INVENTION

Product applicators are designed to deliver a quantity of product. In consumer goods there are, broadly, two types of handheld applicators. There are applicators that are separable from a product container/reservoir. Throughout the specification, a "separable applicator" is one that is disconnected from a product reservoir at the time of applying product to a target surface. In use, a separable applicator is loaded with product from a product reservoir for transfer to a target surface. In contrast, there are applicators that are integral with a product container and therefore, the applicator cannot be separated from the product container. This type of device dispenses product by causing the product to flow from a reservoir, through the interior of an applicator, and out an exit structure, for transfer to a target surface. The present invention is concerned with the first type of heated applicator, that which is separable from a product container.

A heated applicator that is separable from a product container has different issues than a heated applicator that is integral with a dispensing container. In the case of a heated applicator that is separated from a product container at the time of use, the electronic circuitry may be housed solely within the applicator, and not within the container, if power is to be continuously supplied to the applicator. In contrast, in the case of an applicator that is integral with a dispensing container, the electronics is not limited to being housed within the applicator. The container portion provides substantially more space for a layout of electric circuits. In fact, dispensing containers with integral applicators and heating elements may be no larger than dispensing containers with integral applicators having no heating elements. Separable applicators are different, at least in cosmetics and personal care. Here, such applicators tend to be sleek and designed for easy storage in a small purse or pocket. In the personal care field, the drive is always to make smaller, more convenient applicators of this type. Therefore, when the addition of heating components to an applicator requires making the applicator larger, this is a clear disadvantage. This disadvantage is not as often encountered when designing dispensing containers with integral applicators, because dispensing containers with integral applicators do not have to be enlarged at all or to the same degree as separable applicators.

Mascara products are very popular. Today, mascara sales approach eight hundred million dollars per year in the United States alone. Because of this, significant resources are devoted to the development of innovative mascara products. Innovative mascara products are those that introduce new features to the consumer or that improve upon exiting mascaras by making them perform better or by making them less expensive. Innovation in mascara products may occur in the composition or in the applicator used to apply the composition. Being innovative in the field of mascara products can be a challenge because mascara compositions are one of the most difficult cosmetics to formulate, package and apply. In part, this is owing to the physical and rheological nature of the product. Mascara can be a heavy, viscous, sticky and often messy product. It does not flow easily in manufacture, filling or application, while drying out quickly at ambient conditions. It may contain volatile components that make safety in manufacture an issue. Mascara is also difficult because of the target area of application. The eyelashes offer a very small application area, while being soft, flexible, delicate and in close proximity to very sensitive eye tissue. Being flexible, the eyelashes yield easily under the pressure of a mascara applicator which makes transfer of the product onto the lashes difficult. The act of transferring a rheologically difficult product to a small, delicate target and in so doing achieve specific visual effects, is the challenging task of mascara application.

The most common mascara applicator is the mascara brush. A classic mascara brush has a bristle head that comprises a collection of individual filaments disposed within a helical wire core. The wire core depends from one end of an elongated stem, while the other end attaches to a handle. Also known, are molded bristle heads, which are fashioned as a cylindrical sleeve with integrally molded bristle elements radiating from the sleeve. The molded sleeve may be slipped over one end of an elongated stem, while the other end of the stem attaches to a handle. In either case, the radially extending bristles, collectively, form a bristle head or applicator head, the "working portion" of the applicator. For a review of those brush parameters that are recognized by a person of ordinary skill in the art to be results-effective, see U.S. Pat. No. 7,465,114, herein incorporated by reference, in its entirety.

Regarding mascara compositions, there is an established vocabulary for discussing their performance characteristics. Each of these characteristics can be evaluated and assigned a number on an arbitrary scale, from 0 to 10, say, for purposes of comparison during formulation. "Clumping", as a result of mascara application, is the aggregation of several lashes into a thick, rough-edged shaft. Clumping reduces individual lash definition and is generally not desirable. "Curl" is the degree to which a mascara causes upward arching of the lashes relative to the untreated lashes. Curl is often desirable. "Flaking" refers to pieces of mascara coming off the lashes after defined hours of wear. The better quality mascaras do not flake. "Fullness" depends on the volume of the lashes and the space the between them, where "sparse" (or less full) means there are relatively fewer lashes and relatively larger separation between the lashes and "dense" (or more full) means the lashes are tightly packed with little measurable space between adjacent lashes. "Length" is the dimension of the lash from the free tip to its point of insertion in the skin. Increasing length is frequently a goal of mascara application. "Separation" is the non-aggregation of lashes so that each individual lash is well defined. Good separation is one of the desired effects of mascara application. "Smudging" is the propensity for mascara to smear after defined hours of wear, when contacting the skin or other surface. Smearing is facilitated by the mascara mixing with moisture and/or oil from the skin or environment. "Spiking" is the tendency for the tips of individual lashes to fuse, creating a triangular shaped cluster, usually undesirable. "Thickness" is the diameter of an individual lash, which may be altered in appearance by the application of mascara. Increasing thickness is usually a goal of mascara application. "Wear" is the visual impact of a mascara on the lashes after defined hours as compared to immediately after application. "Overall look" is one overall score that factors in all the above definitions. It is a subjective judgment comparing treated and untreated lashes or comparing the aesthetic appeal of one mascara to another. The ideal mascara will possess all of the desirable properties while avoiding the undesirable.

Often, the formulator is interested in achieving thicker, fuller, well separated lashes. Characteristics like clumping and spiking tend to work against this, and a developer can improve one or more characteristics only at the expense of others. For example, to increase the fullness of a particular mascara, conventional wisdom suggests adding more solids (wax) to the composition. However, a disadvantage of doing this is that it tends to increase clumping of the composition and decrease the user's ability to separate the lashes. A high level of solids can also create a negative sensorial effect because the high concentration of solids makes the mascara difficult to spread over the lashes. The result can be tugging on the lashes, discomfort associated therewith and a poor application. The art of conventional mascara formulation can be a balancing act between separation and volumizing, between too much of one and not enough of the other. Embodiments of the heated applicators and formulations address this difficulty. As noted, during formulation, for purposes of comparison, each of the above characteristics can be evaluated and assigned a number on an arbitrary scale. For example, if the performance scale is 0 to 10, then a substantial improvement in mascara performance may be understood as an increase of 1 or more points, in one or more characteristics, preferably with no decrease in any one characteristic.

Conventional mascara formulations include oil-in-water emulsion mascaras which may typically have an oil phase to water ratio of 1:7 to 1:3. These mascaras offer the benefits of good stability, wet application and easy removal with water, they are relatively inexpensive to make, a wide array of polymers may be used in them and they are compatible with most plastic packaging. Oil-in-water mascaras may not stand up well to exposure of water and humidity. Oil-in-water mascaras are typically comprised of emulsifiers, polymers, waxes, fillers, pigments and preservatives. Polymers behave as film formers and improve the wear of the mascara. Polymers affect the dry-time, rheology (i.e. viscosity), flexibility, flake-resistance and water-resistance or water-proofing of the mascara. Waxes also have a dramatic impact on the rheological properties of the mascara and will generally be chosen for their melt point characteristics and their viscosity. Inert fillers are sometimes used to control the viscosity of the formula and the volume and length of the lashes that may be achieved. Amongst pigments, black iron oxide is foremost in mascara formulation, while non-iron oxide pigments for achieving vibrant colors has also become important recently. Preservatives are virtually always required in saleable mascara products.

There are also water-in-oil mascaras whose principle benefit is water resistance and long wearability. These mascaras may typically have an oil phase to water ratio of 1:2 to 9:1. Water-in-oil mascaras are typically comprised of emulsifiers, solvents, polymers and pigments. Volatile solvents facilitate drying of the mascara. Polymers play a similar role in water-in-oil mascaras as in oil-in-water discussed above, although in the former, an oil miscible film forming polymer is recommended. The same classes of pigments may be used in water-in-oil mascaras, as in oil-in-water. Here though, a hydrophobically treated pigment may provide improved stability and compatibility.

U.S. Pat. No. 7,083,347, U.S. Pat. No. 7,090,420, US 2005/0031656 and US2005/0013838 (herein incorporated by reference, in their entirety) disclose a combination of mascara and heating applicator. More specifically, these references describe the use of heating applicators with mascaras that have certain thermal behavior and melting characteristics, when measured according to the patentee's disclosed test methods. For example, the thermal behavior and melting characteristics are measured with the aid of a differential scanning calorimeter.

Due to the various materials found in commercial mascara, a mascara composition displays an initial melting point (defined as the temperature at which 5% of the enthalpy of melting is consumed), an end melting point (defined as the temperature at which 95% of the enthalpy of melting is consumed). These references define formulations according to their temperature amplitude (i.e. final melt temperature minus initial melt temperature). In a DSC plot of heat flow (absorbed power) versus temperature, the initial and final melting points may be observed, as well as one or more peaks. The compositions described in these references are those that exhibit a melting-peak width at mid-height, of less than or equal to 20° C. or 10° C. Furthermore, the '347, '420, '656 and '838 references also disclose that the heating applicator is able to raise the temperature of the formulation above the formulation's melting point (defined as the temperature corresponding to the apex of the peak in the DSC curve).

Furthermore, a careful reading shows that the '347, '420, '656 and '838 references are concerned with "thermally stable" compositions. As that term is defined therein, and adopted here, a "thermally stable" formulation is defined as one whose viscosity varies by no more than 25%, after being subjected to a succession of no fewer than 4 melting/cooling cycles according to the following protocol. The formulation is placed in a temperature chamber at 80° C. for 2 hours. The formulation is then left to return naturally to ambient temperature. Its viscosity is measured after completing at least 4 cycles. A period of 24 hours is left between two successive cycles. The viscosity measured after completing at least 4 melting/cooling cycles, is compared with that measured before the first cycle.

It is known for heated cosmetic and personal care applicators utilize conventional, flexible metallic wiring and contacts for conducting electricity from a power source to a switch, then to a heating element and possibly to one or more light indicators and temperature controls, before returning to the power source. If more than one independent circuit is required, then the number of wires and electrical connections increases proportionately. In contrast, heated applicators according to embodiments of the present invention do not use metal wire conductors or use substantially fewer, do not have the space constraints associated with using wire circuitry, substantially reduce the labor required to assemble an applicator, have more reliable electrical connections and sophisticated electrical options, and reduced circuit length.

OBJECTIVES

Various embodiments of the invention meet one, some or all of the following objectives. The term "objective" does not, by itself, make a feature essential.

One object of the present invention is to provide a handheld mascara applicator that is able to heat at least 0.15 g, preferably at least 0.25 g, more preferably at least 0.40 g, most preferably at least 0.50 g of a product, from an ambient temperature to a product application temperature, in 25 seconds or less, preferably 15 seconds or less, more preferably 10 seconds or less, and most preferably 5 seconds or less.

Another object is to provide such an applicator in combination with a mascara composition having a melting peak, mid-height width of greater than 20° C., 25° C., 30° C., or 35° C., and/or in combination with a mascara composition that has a cooling set time of greater than 5, 10 or 15 seconds, thus providing an improved mascara application, and other advantages.

Another object is to provide such an applicator in combination with a mascara composition having a melting peak, mid-height width of 20° C. or less, and/or in combination with a mascara composition that has a cooling set time of 10 seconds or less, thus providing an improved mascara application, and other advantages, over the prior art.

Another object of the invention is to provide heating applicator with a means for controlling the distribution of heat around the applicator head, that is more precise than anything in the prior art.

Another object of the present invention is to provide an improved heated applicator that has more sophisticated electronics, more power efficient electronics, than prior art heating applicators.

Another object of the present invention is to provide a heated applicator that maintains effective heating over the life of a full size container of mascara (at least 5 g) without having to change or recharge a power source.

Another object of the invention is to provide a heated mascara applicator that has a printed circuit design, in combination with a specific power supply, such that the applicator can provided at least four, more preferably six hours of heating service, without having to change or recharge the power supply, and without a significant decrease in heating performance.

Another object of the invention is to provide a heated mascara applicator that coordinates the number of heating elements with the number of bristles per turn/row, for maximum performance.

Another object of the invention is to provide a heated mascara applicator having a plurality of small, strategically-placed individual heating elements for controlling the distribution of heat around the applicator head.

SUMMARY OF THE INVENTION

Figure 1:
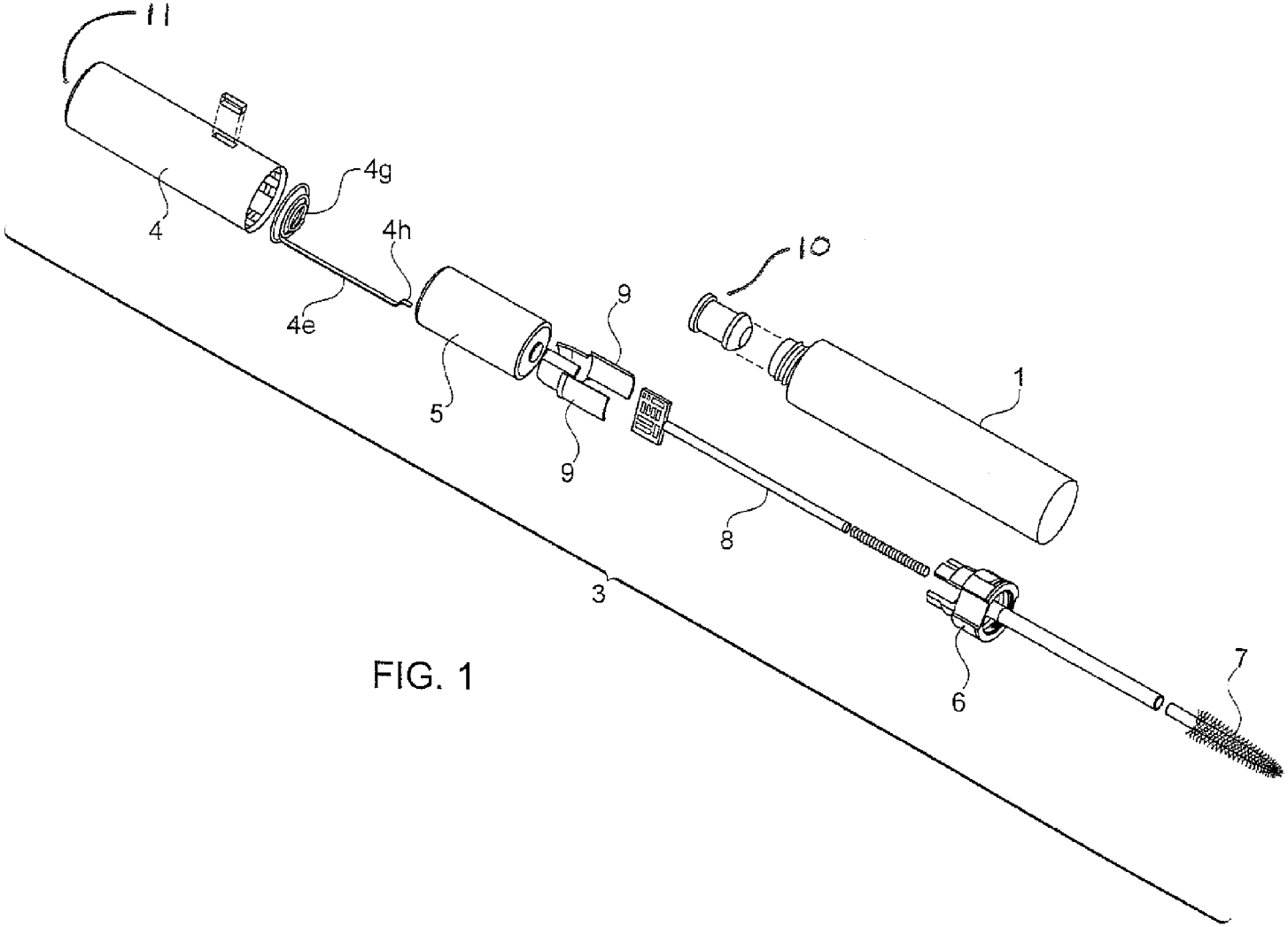
FIG. 1 is a an exploded view of one embodiment of heated mascara applicator according to the present invention.

This summary is provided merely as an introduction, and does not, by itself, limit the appended claims. According to one aspect, the present invention is a handheld mascara applicator comprising an applicator head, a source of electric current, and a heat generating portion that is effective to heat at least 0.15 g of mascara located on the applicator head, from an ambient temperature to a product application temperature, in 25 seconds or less, measured from the moment the heat generating portion is activated.

According to another aspect, the present invention is a handheld mascara applicator comprising an applicator head that has an outer surface and a central, longitudinal axis, and a heat generating portion that is effective to raise the temperature of the outer surface from an ambient temperature to about 55° C. or more, in 25 seconds or less, measured from the moment the heat generating portion is activated.

According to another aspect, the present invention is a system for applying a mascara composition, the system comprising a mascara composition contained in a container, wherein the mascara composition has a thermal profile that has a mid-height, melting peak width of more than 20° C., and a handheld mascara applicator comprising an applicator head, a source of electric current, and a heat generating portion that is effective to heat at least 0.15 g of mascara located on the applicator head, from an ambient temperature to a product application temperature, in 25 seconds or less, measured from the moment the heat generating portion is activated.

According to another aspect, the present invention is a system for applying a mascara composition, the system comprising a mascara composition contained in a container, wherein the mascara composition has a cooling set time of more than about 10 seconds, and a handheld mascara applicator comprising an applicator head, a source of electric current, and a heat generating portion that are effective to heat at least 0.15 g of mascara located on the applicator head, from an ambient temperature to a product application temperature, in 25 seconds or less, measured from the moment the heat generating portion is activated.

According to another aspect, the present invention is a system for applying a mascara composition, the system comprising a thermally dynamic mascara composition contained in a container, and a handheld mascara applicator comprising an applicator head, a source of electric current, and a heat generating portion that is effective to heat at least 0.15 g of mascara located on the applicator head, from an ambient temperature to a product application temperature, in 25 seconds or less, measured from the moment the heat generating portion is activated.

According to another aspect, the present invention is a system for applying a mascara composition, the system comprising a container having at least 4 g of the mascara composition therein, and a handheld mascara applicator comprising a handle, an applicator head, and a power supply housed within the handle, the power supply selectively providing electric current to a heat generating portion, such that, over the lifetime of the container, the heat generating portion, when activated, is effective to heat at least 0.15 g of mascara located on the applicator head, from an ambient temperature to a product application temperature, in 25 seconds or less, measured from the moment the heat generating portion is activated, without having to change or recharge the power supply.

DETAILED DESCRIPTION

The present application is concerned with separable, handheld, heated applicators. A main focus of the present invention is mascara applicators. Although the principles described herein are more broadly applicable, the principles will be described in relation to mascara applicators and mascara application.

DEFINITIONS

"Product application temperature" means a temperature of the product that is greater than ambient temperature, at which some characteristic of the product is enhanced or improved, based on some criteria related to application of the product to skin or hair (for example, the eyelashes) and/or based on the performance characteristics defined above. For example, ambient temperature may be taken to be 20° to 25° C.; product application temperature may be 30° C. or greater, more preferably 40° C. or greater, even more preferably 50° C. or greater, and most preferably 60° C. or greater, up to 90° C.; and the characteristic being enhanced may be a 10% or greater reduction in viscosity, more preferably a 20% reduction in viscosity, even more preferably a 30% reduction in viscosity, most preferably a 40% reduction in viscosity, up to a 90% reduction in viscosity.

In another example, ambient temperature may be taken to be 20° to 25° C.; product application temperature may be 35° C. or greater, more preferably 45° C. or greater, even more preferably 55° C. or greater, and most preferably 65° C. or greater; and the characteristic being enhanced may be 3 point improvement (on the 0-10 scale) in any one of clumping score, curl score, flaking score, fullness score, length score, separation score, smudging score, spiking score, thickness score, wear score, overall look score. Thus, the phrase "product application temperature" includes a change in some product characteristic related to mascara performance, and not just the viscosity, on which some prior art has tended to focus. Thus, even if a mascara's viscosity is not appreciably affected by a change in temperature, the temperature may still fall within the definition of "product application temperature", if, for example, the overall look was enhanced due to increased shine or improved lengthening or for some other reason. Specifically, "product application temperature" may include temperatures above or below a product's initial melting point, peak melting point or end melting point, as determined on a DSC curve. Therefore, unlike some prior art, melting may not be required to achieve an improvement product performance or application.

"Handheld applicator" means an applicator that is intended to be held in one or more hands and raised in the air, as the applicator is performing one or more main activities. Main activities include loading product onto the applicator and delivering product to an application surface. Thus, "handheld" means more than just being able to grasp an object. For example, a "space heater" does not meet this definition of handheld.

"Softened" product means a product heated to a temperature below its apex on a DSC curve, more preferably, 75% of the way between the initial melting temperature and the apex temperature, even more preferably, 50% of the way between the initial melting temperature and the apex temperature, and most preferably, 25% of the way between the initial melting temperature and the apex temperature. Unexpectedly, substantial improvements in mascara performance are achieved when a mascara is heated to a softened state, below its melting temperature. These improvements are especially noted for compositions that are not "thermally stable" as defined above.

Throughout the specification "comprise" means that an element or group of elements is not automatically limited to those elements specifically recited, and may or may not include additional elements.

Throughout the specification, "proximal" means closer to or towards the closed end of the handle, and "distal" means further from or away from the closed end of the handle.

Throughout the specification, "electrical contact" means that a current is able to flow between electronic elements, whether there is direct physical contact between the elements or whether one or more other electronic elements intervene.

Various features of some of the embodiments will now be described. Certain described features may be used separately or in combination with other described or implied features. Some of the embodiments may use only one or more described features.

A. Heated Applicator Overview

One embodiment of a mascara package with heated applicator is shown in FIG. 1. In this embodiment, the package comprises a container (1) for holding a mascara or other product (2). A wiper (10) may be included in the container. The mascara has a particular minimum melting peak, mid-height width and/or a particular minimum cooling set time. The heated applicator (3) includes an elongated structure comprising a proximal end and a distal end. Toward the proximal end is a handle (4) for grasping by a user, which also serves as a housing for a source (5) of electric current and some associated circuitry. Attached to the handle and moving toward the distal end of the applicator is a hollow stem (6). Further toward the distal end, is an applicator head (7), shown in the figures as a molded brush. In this embodiment, the bulk of the electronic circuitry is carried on a printed circuit board (PCB) (8), including specifically, the heat generating elements. The PCB is an elongated structure that passes through the stem, from the electric current source (closer to the proximal end of the applicator) to the applicator head (nearer the distal end of the applicator).

The Handle

Figure 2:
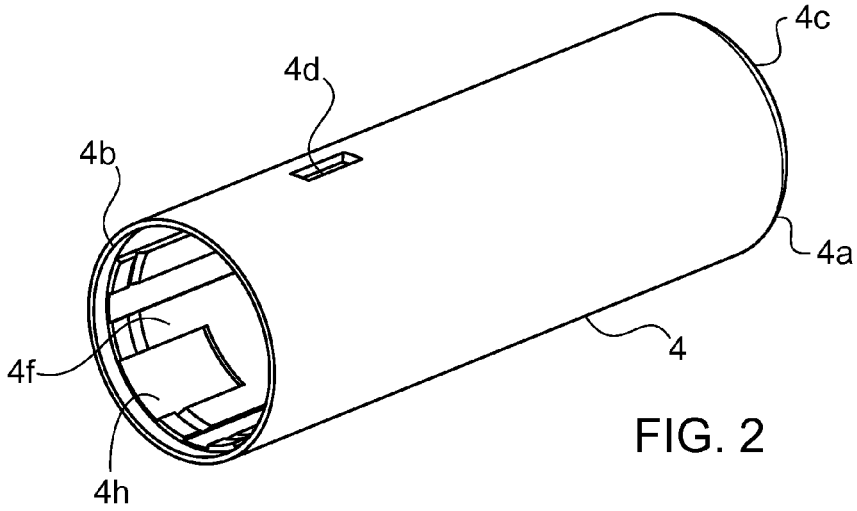
FIG. 2 is a perspective view a handle.

In FIG. 2, the handle (4) is shown as a hollow cylindrical structure, but the shape may vary. The handle is large enough to be grasped by a user of mascara products, as is typically done in the field. For example, the handle may be from 25 mm to 150 mm in length and from 12 mm to 50 mm in diameter. The closed end (4*a*) of the handle defines the most proximal end of the heated applicator. Opposite the closed end of the handle, is an open end (4*b*). The handle may have a removable cap (4*c*) at its closed end (4*a*). The removable cap offers access to the interior of the handle, access to a battery, for example. The handle may be of the type that is designed to act as a closure for the container (1), especially through cooperating threads (not shown). The handle may have a window (4*d*), through which a light emitting diode (LED) element may shine.

The handle (4) interior is sufficiently large to accommodate a current source, such as one or more batteries (5), one or more metallic leads (4*e* in FIG. 1) that create afferent and/or efferent paths to the printed circuit board (8), and optionally, a portion of the PCB. At least one metallic lead (4*e*) may be attached to the inner surface (4*f*) of the handle, such that, when a battery is reposed in the handle, a negative terminal of the battery is able to achieve electrical contact with a first portion (4*g*) of that lead. A second portion (4*h*) of that lead is able to achieve electrical contact with the printed circuit board, such that electric current is able to flow from the printed circuit board, back to the battery, at the negative terminal. If a second metallic lead is present, it may carry electric current from a positive terminal of the battery to the printed circuit board. In a preferred embodiment, the positive terminal of the battery directly contacts the circuit board, so a second lead is not required. Also, a spring may be provided inside the handle. In a compressed state, the spring urges the battery toward the distal end of the applicator (3). In the embodiment of FIG. 1, and preferred, the spring constitutes the first portion (4*g*) of the attached metallic lead (4*e*). Alternatively, the spring may be separate from the metallic lead. For example, the spring may be attached to an inner wall of the cap (4*c*).

Fitted to the handle, and extending toward the distal end of the applicator, is a stem (6). The stem and the handle may be fitted with one or more of: an interference fit, a catch mechanism, adhesive, or any suitable means, depending on the nature of the connection, to be discussed below.

The Stem

Figure 3A:
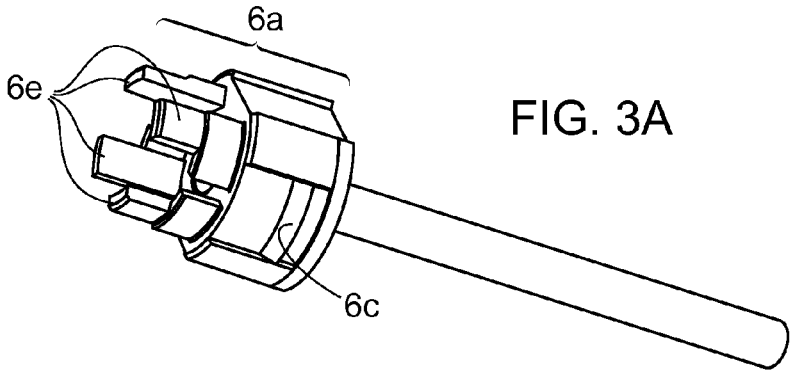
FIGS. 3*a* and 3*b* depict a stem according to the present invention.
Figure 3B:
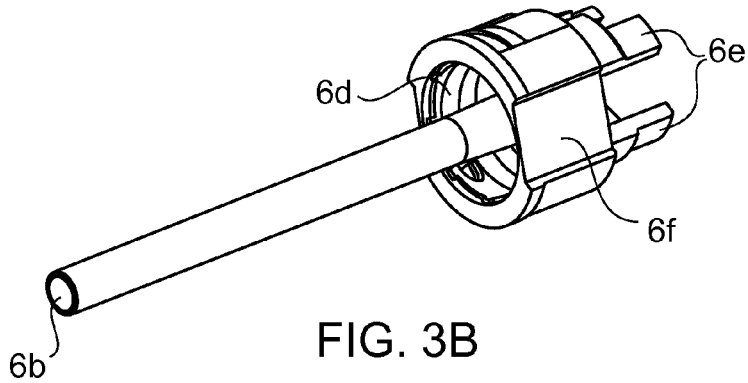

One embodiment of a stem (6) is shown in FIGS. 3*a* and 3*b*. The stem is a hollow, elongated member. A proximal end (6*a*) of the stem is fitted to the handle (4). The stem and the handle may be fitted with one or more of: an interference fit, a catch mechanism, adhesive or any suitable means. For example, when assembled, one or more raised beads on the stem (6*c* in FIG. 3*a*) are forced into the handle until the raised bead of the stem encounters a depression on the inner surface of the handle (4*h* in FIG. 2). The raised bead of the stem expands into the depression of the handle, such that the stem cannot ordinarily be removed from the handle, through an intended use of the applicator (3). In a preferred embodiment, the handle and stem are attached permanently or semi-permanently, which means that a consumer may not easily separate the stem and handle. This arrangement is convenient when the current source is not intended to be replaced. In this case, the battery is assembled into the handle before the assembly operation of the handle and stem.

The stem is hollow, and opened at its proximal and distal ends to permit the printed circuit board (8) to be reposed through it, with portions of the printed circuit board emerging from both ends of the stem. The stem may be of a type that is designed to act as a closure for the container (1), especially through cooperating threads (6*d*). The distal end (6*b*) of the stem may attach to a portion of the applicator head (7).

The proximal end of the stem includes pairs of vertical elements (6*e*). Two pairs of vertical elements are preferred. Each pair of vertical elements interact with one tab (9), in such a way that each tab, when urged, is able to slide proximally and distally on the vertical elements. For example, each pair of vertical elements may act as track rails, which are received into grooves in a tab. As a tab slides on the vertical elements, a distal portion (9*b*) of the tab slides over surface (6*f*) of the stem. The purpose of the tabs is discussed below.

The Applicator Head

Figure 4:
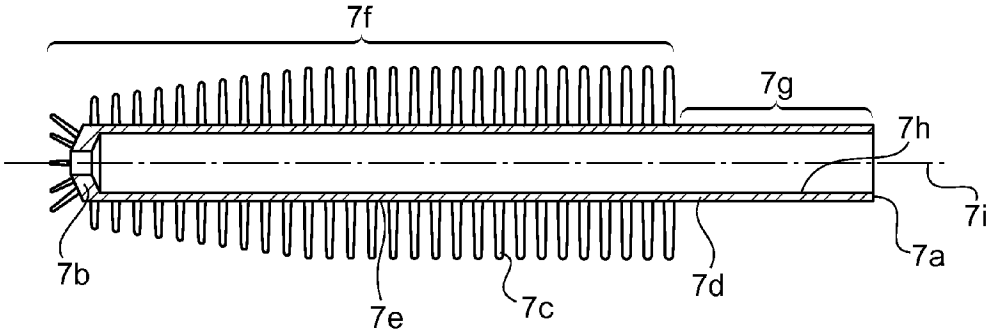
FIG. 4 depicts a molded applicator head.

The applicator head (7) is that part of the device that is used to take product from the container (1) and deliver it to the eyelashes, and groom the eyelashes. In a preferred embodiment, the applicator head includes a molded brush. An example of a molded brush is shown in FIG. 4. The brush is fashioned as an elastomeric member comprising a hollow sleeve (7*d*), having an opened, proximal end (7*a*), an opened or closed distal end (7*b*), and a plurality of bristles (7*c*) projecting from an outer surface (7*e*) of the hollow sleeve. More specifically, the bristles project from a portion (7*f*) of the outer surface. The bristles may be arranged over substantially all of the outer surface (except for the space between bristles), or there may be another portion (7*g*) of the outer surface without any bristles.

The proximal end of the hollow sleeve (7*d*) may attach to the distal end (6*b*) of the stem (6), either by receiving a portion of the stem into the hollow sleeve, or by the proximal end of the applicator head being received into the hollow stem. However, this attachment may not be necessary, because the molded, hollow sleeve is able to receive a distal end of the printed circuit board (8) that is emerging from the distal end of the stem. Preferably, the hollow sleeve fits snugly over the distal end of the printed circuit board. Most preferably, this fit is sufficiently snug to prevent the sleeve from coming off the PCB in normal handling and use. Furthermore, a snug fit of the hollow sleeve on the PCB, improves the efficiency of heat transfer through the sleeve, from the inside, going out, while gaps between the heating elements (8*b*) on the printed circuit board and the hollow sleeve, decrease heat transfer efficiency. Therefore, it is preferable if there are as few gaps as possible between the heating elements on the printed circuit board and the inner surface (7*h*) of hollow sleeve. It is most preferable if there are no such gaps.

In one embodiment of the present invention, the heating elements (8*b*) on the printed circuit board (8) are in direct contact with an inner surface (7*h*) of the hollow sleeve (7*d*) of a molded applicator head (7). This arrangement is effective, but still may leave air-filled gaps underneath the hollow sleeve, between the heating elements, for example. The transfer of heat through the hollow sleeve and into a product on the outer surface of the applicator head may be diminished by these air-filled gaps. Another embodiment of the present invention includes embedding the heating elements in a continuous mass of a heat transfer material. The material may be applied by dipping the distal end of the PCB in heat transfer material that is in a softened state. When the material hardens, there may be virtually no air gaps contacting the heating elements. In at least some embodiments, as long as the heat transfer material improves the rate of heat transfer from the heating elements, through the hollow sleeve, then this embodiment is preferred for many applications. The heat transfer material can form a semi-hardened or hardened cylindrical shell over the distal end of the PCB. The cylindrical shell fits snugly into the cylindrical hollow sleeve. In this way, substantially all of the inner surface of the hollow sleeve may be in direct contact with the heat transfer material that encases the heating elements, and the transfer of heat through the hollow sleeve and into a product is improved. Another advantage of the cylindrical shell is that it may make it easier to slide the sleeve onto the PCB, because the shell provides a smooth, uniform surface compared to the PCB without the heat transfer material. Examples of useful materials for the cylindrical shell of heat transfer material include one or more thermally conductive adhesives, one or more thermally conductive encapsulating epoxies or a combination of these. An example of a thermally conductive adhesive is Dow Corning® 1-4173 (treated aluminum oxide and dimethyl, methylhydrogen siloxane; thermal conductivity=1.9 W/m·K; shore hardness 92 A). An example of a thermally conductive encapsulating epoxy is 832-TC (a combination of alumina and a reaction product of epichlorohydrin and Biphenyl F; available from MG Chemicals, Burlington, Ontario; thermal conductivity=0.682 W/m·K; Shore hardness 82 D). For many applications, a higher thermal conductivity is preferred over a lower thermal conductivity.

Various parameters of the applicator head (7), will affect the amount of heat required to raise the temperature of a product disposed on the bristles, and/or the amount of time required to do it. For example, in general the more bristles (7*c*) present or the larger the bristles, the more heat will be needed to raise the temperature of the product on the bristles, in a given amount of time. This is true because there is more bristle mass being heated, and because there is more product than would be the case if fewer or smaller bristles were present. Also, for example, given a specific rate of heat generation, a thicker sleeve (7*d*) means more time will be needed to raise the temperature of the product on the bristles. This is so because there is more sleeve mass being heated, than if a thinner sleeve was used. To increase the rate of heat transfer through the molded applicator sleeve, and to reduce the amount of heat lost, it may be preferable to make the molded sleeve as thin as possible, considering the limitations of molding in the specific material used. Preferably, the sleeve thickness is less than 1.0 mm, more preferably less than 0.8 mm, even more preferably less than 0.6 mm and most preferably less than 0.4 mm.

Of course, since heat passes through the sleeve and bristles, the amount of heat and/or the length of time needed to raise the temperature of a product disposed on the applicator head, also depends on the thermal conductivity of the material(s). So, in general, to decrease the amount of time required to raise the temperature of the product, one might increase the rate of heat generation, decrease the mass being in heated (applicator head and/or product), and/or increase the thermal conductivity of the applicator head. One might consider reducing the size and mass of the bristles, but that decision should be made with regard to applicator performance in grooming the lashes.

In some embodiments, the temperature of the surface(s) of the applicator head (7) that are in direct contact with the product, will generally be greater than the intended product application temperature. In embodiments described by FIG. 1, the heating characteristics of the applicator head were measured, with and without product on the applicator head. The hotter the outer surface of the applicator head, the shorter the product heat up time. In some embodiments, product application temperatures range from 30° C. or greater up to 65° C. or greater, and times to reach product application temperature from about 25 seconds down to about 5 seconds. In one embodiment of the present invention, product application temperatures may be reached by a molded applicator head that is able to achieve an outer surface temperature (measured without product) of 55° C. or more, in another embodiment 60° C. or more, in still another embodiment 65° C. or more, and in a another embodiment 70° C. or more, in 25 seconds or less. The "25 seconds or less" is measured from the moment that the heat generating portion of the applicator is activated (i.e. "turned on"), whether the heat generating portion itself was at ambient temperature or hotter.

Examples of useful materials for the molded applicator head (7) include plastics, elastomers, or materials characterized by dipole bond crosslinking or hydrogen bond crosslinking, such as thermoplastic elastomers. A thermoplastic elastomer or a combination of more than one thermoplastic elastomer is preferred. In general, the nature of thermoplastic elastomers is such that articles can be consistently manufactured with relatively little variation from batch to batch, by extrusion molding, injection molding, blow molding, thermoforming, heat welding, calendaring, rotational molding, and meltcasting. One definition of thermoplastic elastomer includes the following necessary characteristics: the ability to be stretched to moderate elongations and, upon the removal of stress, return to something close to its original shape; be processable as a melt at elevated temperature; and the absence of significant creep. Examples of suitable thermoplastic elastomers include the following: styrenic block copolymers, polyolefin blends, elastomeric alloys (TPE-v or TPV), thermoplastic polyurethanes, thermoplastic copolyester, and thermoplastic polyamides. Examples of block copolymer TPEs include: Styroflex (BASF), Kraton (Shell chemicals), Pellethane (Dow chemical), Pebax, Arnitel (DSM), and Hytrel (Du Pont). Elastomeric alloys include: Dryflex (VTC TPE Group), Santoprene (Monsanto Company), Geolast (Monsanto), Sarlink (DSM), Forprene (So.F.Ter. S.p.a.), Alcryn (Du Pont), and Evoprene (AlphaGary). Some thermoplastic elastomers have crystalline domains where one kind of block co-crystallizes with another block in one or more adjacent chains. The relatively high melting temperature of the resulting crystal structure, tends to make the domains more stable than they otherwise would be. The specific crystal melting temperature determines the processing temperatures needed to shape the material, as well as the ultimate service use temperatures of the product. Examples of such materials include Hytrel® (a polyester-polyether copolymer) and Pebax® (a nylon or polyamide-polyether block copolymer). For the molded applicator head of the applicator of FIG. 1, Hytrel® and Pebax® are useful in particular embodiments.

Materials for the applicator head, such as thermoplastic elastomers, may be useful in a range of hardness. For example, a Shore D hardness of about 25 to about 82 is preferred for many applications. More preferred are materials having a Shore D hardness of 30 to 72. Even more preferred are materials having a Shore D hardness of 47 to 55.

Optionally, a portion of the applicator head may comprise one or more thermochromic materials. Thermochromic materials change color in predictable ways, when heated. The purpose of the thermochromic material is to provide a visual notice to a user, that the applicator has achieved a certain temperature. Preferably, the portion of the applicator that comprises a thermochromic material, is easily visible to a user during normal use of a mascara applicator. For example, preferably, at least some portion of the thermochromic material will not be covered by mascara, thereby obscuring the color change.

Arrangement of Heating Elements

As noted above, a plurality of bristles (7*c*) project from a portion (7*f*) of the outer surface (7*e*) of the hollow sleeve. The heating elements (8*b*) are reposed within the applicator head (7), underneath the portion of the outer surface that has bristles, for example, underneath the portion of the hollow sleeve (7*d*) that has bristles on its outer surface. It is disclosed, for the first time, that the performance of a heated mascara applicator may be improved by the use of a plurality of discrete heating elements that are arranged with regard to the applicator surfaces that transfer product to the lashes (i.e. the bristle surfaces). The plurality of discrete heating elements, arranged with regard to the bristles, is a performance improvement over the wire resistor or non-discrete heating elements that are continuously distributed in space.

As is often the case with mascara brushes, be they molded bristles or bristles fixed within a twisted wire core, the linear distribution of bristles along the length of the brush (i.e. along a central, longitudinal axis (7*i*) down the applicator head) is constant or changes non-randomly. Herein, "central axis", "longitudinal axis" and "central, longitudinal axis" mean the same thing. In one embodiment, having multiple discrete heating elements (8*b*), the linear distribution of heating elements along the central, longitudinal axis, underneath the bristles, closely matches the linear distribution of the bristles along the central axis. For example, if the linear distribution of bristles is constant or nearly so, then preferably, the linear distribution of heating elements is constant or nearly so. If the linear distribution of bristles is not constant, but changes as you move down the central axis, proximal to distal, then it is advantageous if the linear distribution of heating elements is not constant, but changes in a similar manner. An example of a mascara brush that may be useful in the present invention, wherein the linear distribution of bristles is not constant, but changes non-randomly along the longitudinal axis, is found in U.S. Pat. No. 5,482,059 and U.S. Pat. No. 5,709,230 (herein incorporated by reference, in their entirety). These references describe an applicator head having three distinct sections of bristles. There is a middle section that has a greater density of bristles than either end section, and one end section has a density of bristles that is similar to the other end section. Thus, this applicator can be modified to have heating elements arranged in three sections; a middle section having a greater density of heating elements than the two end sections;

and the two end sections having a similar density of heating elements. Furthermore, the linear distribution of the heating elements in each section should maintain the same proportions as the linear distribution of bristles in each section.

In FIGS. 1, 4 and 5, the bristles are arranged in rows or, in the case of a spiral pattern, the bristles are arranged in turns about a core or central, longitudinal axis. When using multiple discrete heating elements, it is advantageous to consider the ratio of the number of heating elements to the number of rows/turns of bristles. Preferably, the ratio is 1:1 or more, more preferably the ratio is 2:1 or more, even more preferably the ratio is 3:1 or more, and most preferably the ratio is 4:1 or more. As noted above, mascara brushes having a per-turn pitch of about 2 mm, are typical. Thus, the number of heating elements for a typical mascara brush having a pitch of about 2 mm between adjacent turns, may be restated as 1 or more, per 2 mm of bristle core/central axis length; more preferably, 2 or more heating elements per 2 mm of bristle core/central axis length, even more preferably, 3 or more heating elements per 2 mm of bristle core/central axis length; most preferably, 4 or more heating elements per 2 mm of bristle core/central axis length. Also, as noted above, mascara brushes having from 10 to 60 bristles per turn are typical. Therefore, a preferred ratio of heating elements to bristles is from 1:30 to 1:60 or more, more preferably the ratio is from 1:15 to 1:20 or more, even more preferably the ratio is 1:5 to 1:10 or more, and most preferably the ratio of heating elements to bristles is 1:2.5 to 1:3.3 or more. For example, effective applicators of the type shown in FIG. 1, have been produced having from 100-300 bristles and 16 to 40 heating elements. What is unknown heretofore, are heated applicators having a specified number of discrete heating elements per bristle turn, or per length of core, or per bristle, that number being constant or variable over the length of the core. Also unknown are heating applicators comprising a plurality of discrete heating elements that are arranged with regard to the linear distribution of the bristles.

The use of a plurality of discrete heating elements that are arranged with regard to the linear distribution of the bristles improves the heating efficiency of the device, and provides a means for customizing the same basic design to specific situations. For example, a non-discrete, continuously distributed heating element, that typically runs the length of the applicator head, such as a resistive wire, cannot conveniently deliver different amounts of heat to different parts of the applicator head in a predefined, and controlled manner. In the applicator of FIG. 1, this can be achieved easily, in manufacture, by supplying different regions of the applicator head with discrete resistors having different resistances. Another way would be to supply different regions of the applicator head with a different density of resistors. Because the heat generated by each resistive element depends on the applied voltage and the current through the element, the resistive elements can be arranged in series or parallel or any combinations thereof, to enhance power efficiency, lower power consumption, and/or distribute power asymmetrically, in a way that a single, continuously distributed resistive heating element cannot. In fact, a continuous heating filament, such as a wire coil, produces a decreasing amount of heat downstream from the voltage source, due to a drop in voltage as you move down the wire. Some embodiments of the present invention avoid this uneven heating by allowing at least some ("at least some" includes "all") individual heating elements to be arranged in a parallel electric circuit, thus providing at least some heating elements with the same voltage. These embodiments address uneven heating, and do so in the small confines of a commercial mascara applicator, at a reasonable cost (in relation to the beauty market).

The Printed Circuit Board

Figure 5A:
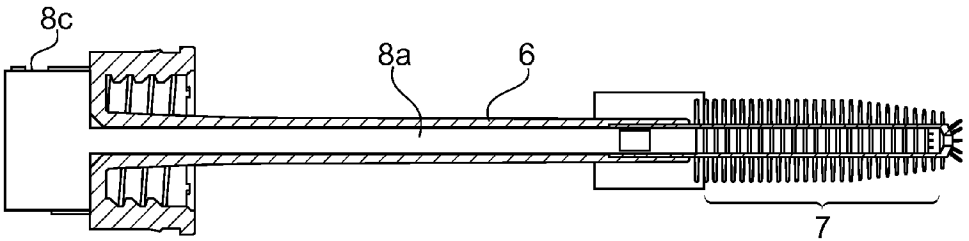
FIGS. 5*a* and 5*b* show a printed circuit board and its relationship to the stem and applicator head.
Figure 5B:
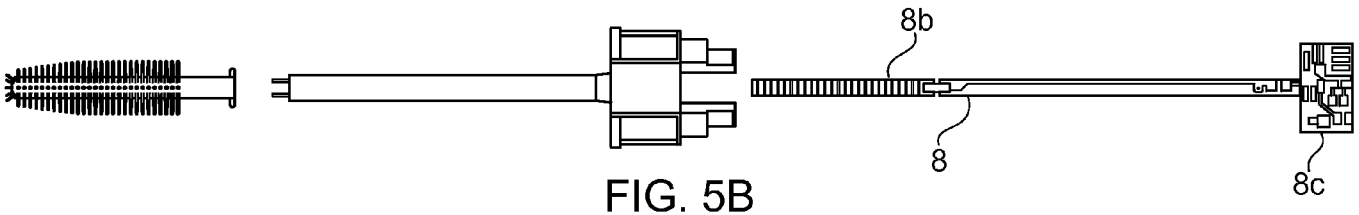

Referring to FIGS. 5*a* and 5*b*, the printed circuit board (PCB) (8) is an elongated structure that passes through the stem (6), from the electric current source (5) to the applicator head (7). The printed circuit board comprises a substrate (8*a*) that is non-conductive to electricity. Suitable substrate materials include, but are not limited to, epoxy resin, glass epoxy, Bakelite (a thermosetting phenol formaldehyde resin), a and fiberglass. The substrate may be about 0.25 to 5.0 mm thick, preferably 0.5 to 3 mm, more preferably, 0.75 to 1.5 mm thick. Portions of one or both sides of the substrate may be covered with a layer of copper, for example, about 35 μm thick.

The substrate supports a heat generating portion, electronic components and conductive elements. Among the conductive elements supported by the PCB, are electrical leads and/or terminals that that are effective to connect the PCB to a battery (5) (or other current source).

The applicator comprises a switchable circuit that includes the heat generating portion. This switchable circuit is formed by the articles on the PCB (i.e. conductive elements, electronic components and the heat generating portion) in combination with a battery, and a switching mechanism. This circuit may include other elements, as well. When this switch is closed, current is flowing to the heat generating portion, and this defines the heat generating portion as "on". When this switch is opened, current is not flowing to the heat generating portion, and this defines the heat generating portion as "off". The applicator may comprises other circuits, as well.

Figure 6:
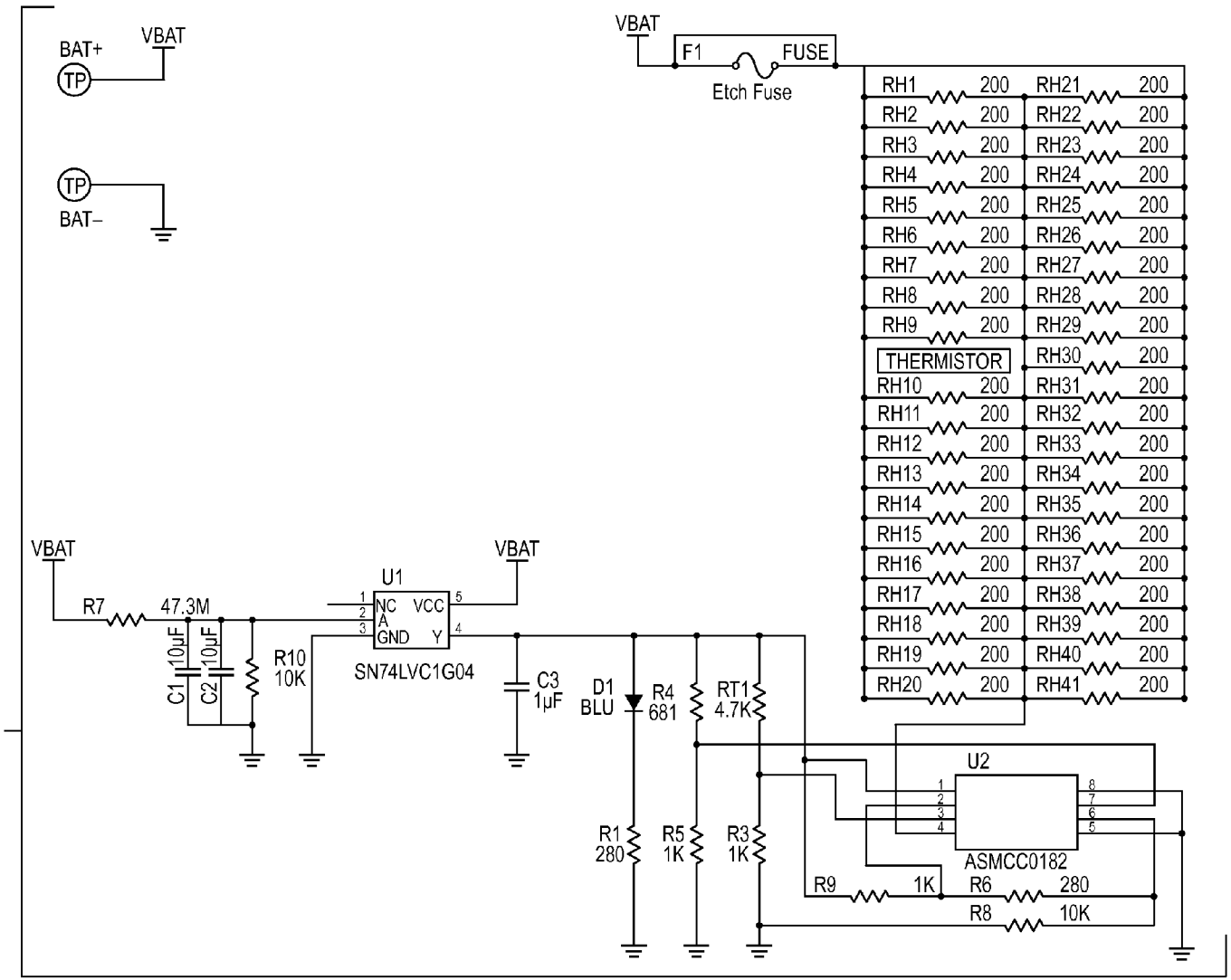
FIG. 6 is a schematic of one possible electronic circuit used in the present invention.
Figure 7:
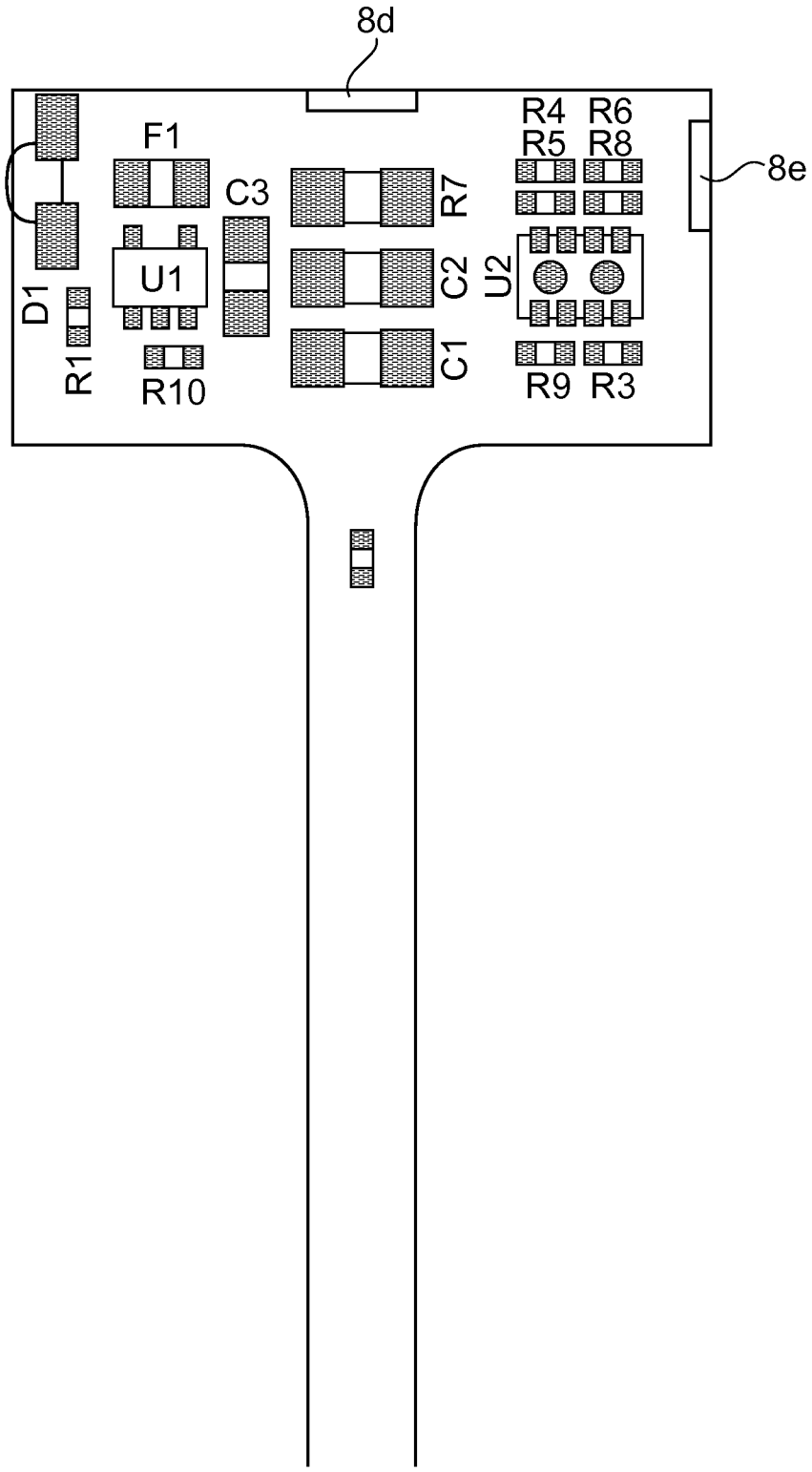
FIG. 7 shows one possible electronic circuit laid out on a printed circuit board.

The printed circuit board may have various electronic elements. As an example, a printed circuit board will be described that supports various elements in a preferred (but not exclusive) arrangement. FIG. 6 shows one possible switchable, electronic circuit used in the example of FIG. 1, laid out on a printed circuit board (8). FIG. 7 shows one possible layout of electronic elements on the PCB. Electric current from a power source (5), (a 3 volt battery, for example) enters the printed circuit board at a PCB terminal (8*d*). This terminal may occupy an edge of the enlarged portion (8*c*) of the PCB. In a preferred embodiment, the positive terminal of the battery (5) directly contacts a terminal of the PCB. Resistor R7 and parallel capacitors C1 and C2, interact with a power inverter U1, to automatically shut off current to the heat generating portion when the capacitors are full. The capacitors may be, for example, ceramic chip capacitors, fastened to or otherwise associated with the PCB. The rated capacitances are chosen to control the length of time from when the switchable circuit is first closed to when the switchable circuit (and heat generating portion) will automatically turn off. For example, the heat generating portion may automatically turn off after about 2 to 2.5 minutes or after about 2 to 3 minutes of use, as desired. This overhead timer, automatic shut off feature is optional, and prevents the battery from running down if the user fails to turn off the circuit. Depending on the level of sophistication employed, an overhead timer, such as the capacitor-based one shown in FIG. 6, may require a reset period, following an automatic shut off, in which the heating elements cannot be activated (i.e. cannot be "turned on"). The reset time, which may be several seconds, allows the capacitors to discharge.

RT1 is an NTC thermistor. In an applicator of FIG. 1, the NTC thermistor is physically located in close proximity to the heating elements (8*b*). For example, in the circuit diagram of FIG. 6, a space is shown between heating elements RH9 and RH10. The NTC thermistor may be located in that space, or any space where it could detect slight variations in the ambient temperature of the space surrounding the heating elements. The NTC thermistor and a fixed value resistor R3, are configured as a voltage divider circuit that creates a voltage level that is proportional to and/or varies with the temperature of the heating elements. That voltage level is monitored by an operational amplifier and is passed to the operational amplifier at the inverting input (pin 3 of U2). A threshold reference voltage is produced by another voltage divider circuit at R4 and R5, and this voltage is connected to the non-inverting input (pin 7 of U2) of the operational amplifier. In this way, the operational amplifier is used as a voltage comparator. When the output voltage of the voltage divider circuit that includes the negative temperature thermistor crosses the reference voltage (either rising above or falling below), then the output of the operational amplifier (pin 2 on U2) changes state. The output of the op amp is passed to an N-channel MOSFET switch (at pin 6 of U2), and is used to control the state of MOSFET switch. When the switch is closed, current flows from the switch (at pin 4 of U2) to the resistive heating elements (8*b*). When the switch is opened, current cannot flow to the resistive heating elements. An edge of the enlarged portion (8*c*) of the PCB (8) is provided with a second terminal (8*e*), which leads to the negative battery terminal through the metal strip and coil (4*g*).

The circuit may further include noise reducing components, such as capacitor C3, an on/off indicator, such as LED D1, and multiple fused portions, such as at F1. Also, more than 1 thermistor can be used to increase the temperature monitoring capabilities.

The circuit, as described, includes a system that actively measures the output temperature and adjusts itself to meet a desired temperature. A heating applicator that includes this circuit can stay on indefinitely, holding a desired temperature, with no concern for overheating. Also, through the use of an automatic shut off and through the monitoring of the temperature of the heating elements, power utilization is significantly reduced. In this regard, the present invention may provide a commercially feasible heated mascara applicator with a level of precision and reliability described herein.

The circuit may further include a system for monitoring and maintaining an output voltage of the power source. For example, batteries are rated with a nominal voltage, such 3 volts, but there is some variability from battery to battery, and from use to use of the same battery. An optional system may be included that monitors and adjusts as needed, the battery voltage, to maintain a tighter tolerance of voltage than the battery normally supplies. One benefit of such a system is improved consistency in applicator performance and improved predictability in battery lifetime.

All of the electronic elements or components except the resistive heating element(s) (8*b*) may be located on an enlarged portion (8*c*) of the printed circuit board (8), near the proximal end of the board. The PCB itself may have any shape or dimensions that are convenient to manufacture and assemble into the stem (6) and applicator. For example, the PCB may have an overall length that extends from the electric current source (5) to the applicator head (7). This length depends on the overall length and design of the applicator, but may often be 30 mm to 150 mm, more preferably, 50 to 120 mm, even more preferably 75 to 100 mm. The largest lateral dimension of the enlarged portion (8*c*) must be less than the interior dimension of that part of the applicator in which it resides. For example, in the figures, the enlarged portion of he PCB resides in the handle. Therefore, the lateral dimensions of the enlarged portion should not exceed the interior diameter of the handle. The handle may be about 12 mm to 50 mm in diameter, for many applications.

The circuit described above utilizes a printed circuit board to form an electronic circuit subassembly, that can be inserted into the plastic housing and connected to power. This electronic circuit subassembly is not dependent on the applicator housing for its structural integrity, nor for its electrical operation. The use of a printed circuit subassembly may result in a cost savings, and error reduction in manufacture. Thus, the circuit herein described may provide a truly effective, commercially feasible, aesthetically acceptable, battery powered, heated mascara applicator, with the performance, reliability and convenience herein described, and may well achieve a cost savings and error reduction in manufacturing.

Heating Elements

The heat generating portion of the applicator of FIG. 1 includes a plurality of individual, discrete resistive heating elements (8*b*), located near the distal end of the printed circuit board, underneath the applicator head. Preferably, the heating elements are located only under that portion (7*f*) of the applicator head that has bristles, according to the linear distribution, and heating element-to-bristle ratios described above, and not under that portion (7*g*) that does not have bristles, so as to minimize wasted heat energy. A preferred embodiment of the discrete resistive heating elements is a bank of fixed value resistors electronically arranged in series, parallel, or any combination thereof, and physically situated in two rows, one on either side of the PCB. The number of resistors and their rated resistance is governed, in part, by the heating element-to-bristle ratios described above, and by the requirements of heat generation of the circuit. In one embodiment, 41 discrete resistors of 5 ohms are uniformly spaced, 20 on one side of the PCB, and 21 on the other side, underneath the entire length of that portion (7*f*) of a molded applicator head that has bristles. In another embodiment, 23 6-ohm resistors are used, 11 on one side of the PCB, 12 on the other. In still another working model, forty-one 3-ohm resistors are used, 20 on one side, 21 on the other. The side with 1 fewer resistor leaves a space for a thermistor. Typically, the applicator of FIG. 1 might use individual resistive elements having rated resistances from 1 to 10 ohms. However, this range may be exceeded as the situation demands. Typically, the overall resistance of all the heating elements might range from 1 to 10 ohms. However, this range may be exceeded as the situation demands.

One preferred type of resistive heating element is a metal oxide thick film resistor. These are available in more than one form. One preferred form is a chip resistor, which is thick film resistor reposed on a solid ceramic substrate and provided with electrical contacts and protective coatings. Geometrically, each chip may be approximately a solid rectangle. Such heating elements are commercially available, in a range of sizes. For example, KOA Speer Electronics, Inc (Bradford, Pa.) offers general purpose thick film chip resistors, the largest dimension of which is on the order of 0.5 mm or less. By using resistors whose largest dimension is about 2.0 mm or less, better, in one embodiment 1.0 mm or less, even better, in another embodiment 0.5 m or less, the resistors can easily be arranged with regard to the number of rows/turns of bristles. In general, the size resistor used might be related to the pitch of the bristle turns (or spacing between rows of bristles). In one embodiment, this might be about 2 mm, but if the pitch is larger or smaller, then it may be advantageous to use larger or smaller resistors.

Typically, chip resistors may be attached to the PCB by known methods. A more preferred form of metal oxide thick film resistor, is available as a silk screened deposit. Without a housing, such as the chip resistor, the metal oxide film is deposited directly onto the printed circuit board, using printing techniques. This is more efficient and flexible from a manufacturing point of view than welding chip resistors. The metal oxide film may be deposited on the PCB as one continuous heating element, or it may be printed as individual dots. For reasons discussed above, the discrete dots may be preferred to the continuous deposit. Various metal oxides may be used in thick film resistor manufacture. One preferred material is ruthenium oxide ($RuO_2$). The individual dots may be printed as small as about 2.0 mm or less, more preferably 1.0 mm or less, most preferably 0.5 mm or less, and their thickness may vary. In fact, by controlling the size of the dots, one may alter the resistance of each dot. Also, the resistance of the thick film resistor, whether in a chip resistor or silk screened form, may also be controlled by additives in the metal oxide film. Typically, chip resistors and silk screened metal oxide dots of the type described herein, may have a rated resistance of 1 to 10 ohms.

A printed circuit board that carries silk screened thick film resistors or chip resistors, is less bulky than one that carries prior art heating elements such as a wire coil. This enables the diameter of the applicator sleeve to be smaller than other devices. The smaller diameter means that the flux of heat into the product is increased, and less heat is wasted heating the sleeve.

The Power Source

The applicator of FIG. 1 further comprises a source (5) of electric current, preferably a DC power supply. The current source is housed within the interior of the handle (4), which is sufficiently large to accommodate the current source. The current source has at least one positive terminal and at least one negative terminal, the terminals forming part of an afferent path (going away from the current source) and efferent path (going toward the current source), respectively. One or more of the power source terminals may directly contact a conductive element on the printed circuit board (8), or one or more electrical leads may intervene, like a coil or spring (4*g*) discussed above.

In regards to power performance, some embodiments of a heated applicator have one or more of the following properties. These properties are: a high product temperature, a fast heat up time, and a battery lifetime that is greater than the package lifetime. In one or more embodiments, some or all of these may be achieved without a noticeable decline in applicator performance over the lifetime of the package.

Therefore, in the applicator of FIG. 1, each time the heated applicator is activated (or "turned on"), it is preferable if the power source is able to provide, by itself, sufficient energy to raise the temperature of a mascara product, as described herein. Preferably, the power source (5) is able to last, without recharging, and without a substantial decline in applicator performance, during the lifetime of a typical full size, (i.e. non-promotional size) commercial mascara container. "Lifetime" of a container refers to the time that it takes for a user to extract and apply as much product from the container as possible, in normal, intended use. A typical full size mascara container, useful in the present invention, may be filled in the filling plant, with at least 4 g of product, preferably at least 6 g of product, more preferably at least 8 g of product, and most preferably at least 10 g of product. In relation to the power source, "substantial decline in applicator performance" means that the time to heat 0.15 g of mascara on the outer surface of the applicator head, from an ambient temperature to a "product application temperature" (defined above), exceeds 25 seconds, in the lifetime of the mascara container. Thus, if a single use includes making up two eyes, then preferably, the power source will last without a substantial decline in applicator performance for 100 uses or more, more preferably 150 uses or more, even more preferably 200 uses or more, and most preferably 250 uses or more. Giving about 2 minutes for each use, this means that the powers source will preferably last without a substantial decline in applicator performance for 200 minutes or more, more preferably 300 minutes or more, even more preferably 400 minutes or more, and most preferably 500 minutes or more. At the time of writing, there is a lack of heated mascara applicators in the cosmetic and personal care market place that meet these requirements, and it was not clear that these power requirements could be achieved with a commercially available battery, while maintaining other factors required for cosmetic market success (i.e. aesthetics, ease of use, etc.). The lack of heated mascara applicators in the cosmetic and personal care market place underscores how difficult it has been to create a truly effective, commercially feasible, aesthetically acceptable, battery powered, handheld, heated mascara applicator, with the performance characteristics just described.

In a preferred embodiment, the DC power supply includes one or more batteries (5), more preferably exactly one battery. Many types of battery may be used, as long as the battery can deliver the requisite power, over the lifetime of the package, to achieve the performance levels herein described. Examples of battery types include: zinc-carbon (or standard carbon), alkaline, lithium, nickel-cadmium (rechargeable), nickel-metal hydride (rechargeable), lithium-ion, zinc-air, zinc-mercury oxide and silver-zinc chemistries. Common household batteries, such as those used in flashlights and smoke detectors, are frequently found in small handheld devices. These typically include what are known as AA, AAA, C, D and 9 volt batteries. Other batteries that may be appropriate are those commonly found in hearing aides and wrist watches.

While, from a power performance standpoint, some of these batteries may be useful in the applicator of FIG. 1, the choice of battery may depend on other factors. For example, more power generally means larger and heavier batteries. A larger and heavier power source means that the applicator must be larger and heavier, perhaps beyond what the consumer has come to expect or is willing to tolerate. In the personal care market, slim, compact, lightweight and portable are usually the rule. There is a limit to what the cosmetic market will accept, from an aesthetic and functional standpoint. Mascara application requires fine, patient movement of a bristle brush around the delicate eye area, with the working hand suspended in the air for an extended period of time. A heavy, poorly balanced applicator makes it difficult to achieve acceptable results and the experience is not as pleasant as it could be. Thus, while in theory, beefing up the battery might improve applicator performance, even a single AA battery may create issues in the marketplace. AA batteries are 51 mm long and 13.5 to 14.5 mm in diameter. They weigh roughly from 15 g to 31 g, depending on the chemistry used. The more powerful AA batteries (and more expensive and heavier) provide up to 3000 mA-hours at fewer than 1.5 volts. That translates to fewer than 75 minutes of use at a required rate of heat generation. Likewise, a single AAA battery cannot supply the requisite power, over the lifetime of the package, to achieve the performance levels herein described. The nominal voltage of AAA batteries is, at most, 1.5 volts, providing about 800-900 mAmps.

Adding a second AA or AAA battery is unacceptable for many applications, from a design and aesthetic standpoint, because the handle begins to be too long, too fat, and too heavy. A single AAA battery is 44.5 mm in length and 10.5 mm in diameter and weighs around 7.6 g to 11.5 g, depending on the chemistry. Rechargeable batteries typically exhibit increased weight (even more than their non-rechargeable counterparts), increased cost, disposal issues (which vary from location to location), they require the consumer to do something, and they do not alleviate the problem that the applicator might not be ready to perform when the consumer goes to use it.

Furthermore, it is preferable if the battery is disposable in the ordinary household waste stream. Therefore, batteries which, by law, must be separated from the normal household waste stream for disposal (such as batteries containing mercury) are less preferred.

In one noteworthy embodiment, the power performance needs of the heated applicator of FIG. 1 may be met by a single, non-rechargeable battery, based on a lithium/manganese dioxide chemistry (having no mercury), that provides a nominal 3 volts and that has a capacity of at least 1,400 mAmp-hours, for example, 1,400-1,800 mAmp-hours. "Nominal 3 volts" includes 2.5-3.5 volts. The combination of a heating applicator herein described and such a battery, is able to heat a product from an ambient temperature to a product application temperature, repeatedly, within the maximum times herein defined, and without a substantial decline in applicator performance as herein defined. One such commercially available battery is the Energizer® 123 (nominal 3 v, 1,500 mAmp-hours). Furthermore, as disclosed herein, it is possible to construct a heating applicator that is acceptable from an aesthetic and functional point of view, by using a battery having dimensions similar to the Energizer® 123. The Energizer® 123 is 34.5 mm long, 17 mm diameter and weighs 16.5 g. Thus, in its dimensions, the Energizer® 123 is shorter, fatter, and intermediate in weight, compared to the AA or AAA. The Enercell® CR123 is another useful commercially available nominal 3 volt battery. It is rated for a capacity of 1,400 mAmp-hours.

Optionally, the power source may be replaceable or rechargeable. For example, the handle (4) may have a removable cap (4*c*) at its closed end (4*a*). The removable cap offers access to the interior of the handle, and a battery (5). Alternatively, or in addition to being replaceable, the battery may be of the rechargeable type. To that end, either the battery can be removed from the handle, as just described, or the exterior of the handle is provided with electric leads to the battery, such that the applicator device can be reposed in a charging base, so that power from the base is transmitted to and stored in the battery. While these optional features are disclosed herein, their implementation may depend on various factors. For example, depending on the part of the world in which the applicator is being sold and used, disposal of batteries is governed by regulation. In particular, the sale, use and disposal of rechargeable batteries may be subject to more demanding restrictions than non-rechargeable batteries. For these reasons, for other environmental concerns, and for consumer convenience, preferred implementations of the applicator of FIG. 1 include a single power source that is sufficient, in normal use, to provide heat for the application of the contents of at least one entire product container. When this is the case, as mentioned above, this preferred embodiment does not offer access to the battery in the handle, and the battery can be disposed of in the normal household waste stream such as lithium-based batteries described herein.

In one embodiment of the applicator of FIG. 1, using a single battery rated for nominal 3 volts at 1,400 mAmp-hours, the following heat up data were obtained using a FLIR A320 thermal camera.

| Heat-up time (seconds) | Surface temperature of molded applicator head (° C.) |
|---|---|
| 0 | 24.6 |
| 5 | 31.9 |
| 10 | 39.7 |
| 15 | 46.6 |
| 25 | 58.7 |

The applicator head continued to heat up beyond 25 seconds, until around 40 seconds, when the temperature leveled off at around 72° C., and held that temperature, within a small variation, until about 150 seconds (two-and-a-half minutes). Below 70° C., the data fits an approximate straight line, which means that heat up commences as soon as the power is turned on and heat up proceeds at a steady rate.

The leveling off temperature can be adjusted to a desired temperature by varying the sizes of one or more resistors R4 and R5, in the voltage divider circuit described above. For example, it is possible to set the leveling off temperature any where from 30° to 90°. Preferably, after leveling off, the small variation in temperature is less than ±2° C., more preferably, less than ±1° C., when measured in a room temperature environment.

The On/Off Switch

The applicator of FIG. 1, further comprises at least one on/off switch. Generally, the on/off switch is capable of alternately interrupting and re-establishing the flow of electricity between the power source and the heating elements.

In one embodiment, at least one of the on/off switches includes one or more switches accessible from the outside the applicator that can be engaged, either directly or indirectly, by a finger of the user. This type of on-off switch is "manual", requiring the user to directly engage the switch, which is something that a user does not have to do with a conventional, non-heating mascara. The details of such switches are well known in the electrical arts and there are many suitable types. Some non-limiting examples include: toggle switches, rocker switches, sliders, buttons, rotating knobs, touch activation surfaces, magnetic switches and light activated switches. Also, multi-position switches or slider switches may be useful if the heating elements are capable of multiple heating output levels. A manual switch may be located on the handle, either on the side wall or on the end of the handle, where it is directly accessible. Optionally, when a switch, such as a button (11), is located on the handle, a cap may be provided that fits over the button. The cap may serve to hide the button for aesthetic reasons or it may protect the button from being unintentionally switched on, while being carried in a purse, for example.

In a preferred embodiment, a manual switch is not used and the heating elements are automatically switched on and off (i.e. activated and deactivated). "Automatically switched" means that the heating elements are turned on or off as a result of normal use of the applicator. For example, when the mascara applicator (3) is drawn from the container (1), the heating elements (8*b*) may be activated automatically, and deactivated when the applicator is reinserted into the reservoir. In this embodiment, a switch is located in such a place on or within the applicator so that, when the handle (4) is being separated from or attached to the reservoir, a flow of electricity to the heating elements is established or interrupted, respectively. Many arrangements are possible.

Figure 8A:
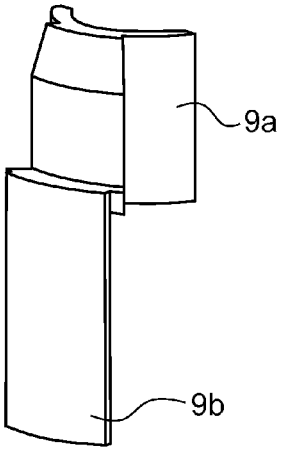
FIGS. 8*a* and 8*b* show the tabs, in detail.
Figure 8B:
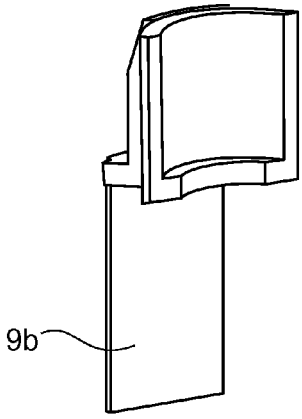
Figure 9A:
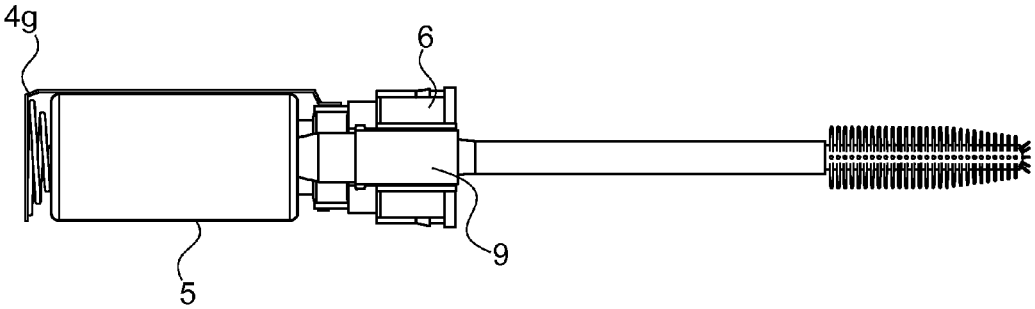
FIGS. 9*a* and 9*b* show the relative positions of the spring, battery and tab, in first and second position.
Figure 9B:
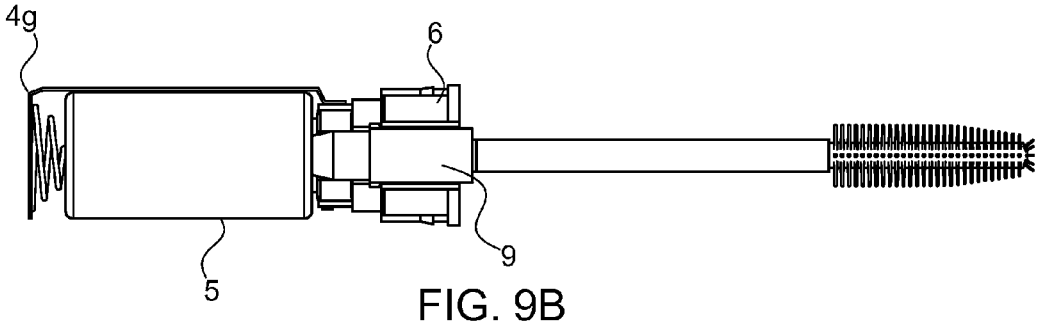

For example, in a preferred embodiment, the metal spring (4*g*) serves a dual purpose. A first purpose of the metal spring, as noted earlier, is to serve as an electrical lead to the negative terminal of the battery (5). A second purpose, is to urge the battery from a first position to a second position. In the first position (when the spring is more compressed), the battery's positive terminal is not making electrical contact with the printed circuit board (8) in a way that would allow current to flow to the heating elements. In the second position (when the spring is more expanded), the battery's positive terminal is making electrical contact with the printed circuit board (8), in a way that allows current to flow to the heating elements. In a preferred embodiment, the enlarged portion (8*c*) of the printed circuit board comprises an electric lead (8*d*) that is able to contact the positive terminal of the battery, when the battery is in its second position. For example, the electrical lead (8*d*) is near a proximal edge of the enlarged portion. In this embodiment, one or more tab elements are provided. For example, two tab elements (9) are shown in FIG. 1. The tabs are shown in more detail in FIGS. 8*a* and 8*b*. A proximal portion (9*a*) of each tab is mated to slide between two vertical elements (6*e*) of the stem (see FIG. 3*b*). As it does so, a distal portion (9*b*) of the tab slides over surface (6*f*) of the stem. The proximal end of each tab contacts the distal end of the battery (5). Each tab is able to slide between a first and a second position, which correspond to the battery being in its first and second position, respectively. For the tab and battery, the first position is achieved when the applicator (3) is seated on the container (1). As the applicator is mounted to the container, the distal end of each tab contacts a portion of the container, forcing each tab to slide toward the proximal end of the applicator (toward first position). As the tabs slide proximally, they push on the battery, thus moving the battery proximally, toward its first position. As the battery moves proximally, the spring (4*g*) is compressed. As noted earlier, in the first position the battery's positive terminal is not making electrical contact with the printed circuit board (8) in a way that would allow current to flow to the heating elements. Then, as the applicator is removed from the container, the spring expands, pushing the battery toward its second position. In the process, the distal end of the battery pushes on the proximal ends of the tabs, causing them to slide distally over the stem (6). When the battery reaches its second position, the battery's positive terminal makes electrical contact with the printed circuit board (8), in a way that allows current to flow to the heating elements. When each tab reaches its second position, the distal end of each tab protrudes distally, beyond a surface (6*f*) of the stem (see FIG. 9*b*), from where it may again engage a portion of the container, when the applicator is re-attached to the container. FIGS. 9*a* and 9*b* show the relative positions of the spring, battery and tab, in the first and second positions. In FIG. 9*a*, the container is not shown, for clarity.

In this preferred embodiment, the heating elements are powered as the applicator is being removed from the container. The heating elements are automatically turned off when the applicator is being reengaged to the container. From a user point of view, the handle is effectively an automatic switch. Thus, there is no chance that a user will leave the heating elements on while the applicator is in the container. This will preserve the product for the life of the package. In another embodiment, there may be more than one on-off switch in a single applicator. A first switch could be the preferred automatic handle switch as just described, and a second switch could be a manual switch. These could be wired to operate as a so-called "three-way" switch, giving the user the option of over-riding the automatic handle switch.

Mascara applicators that are said to have performance enhancing features, are known. It may be useful to combine these with some or all of the principles of the present invention. For example, ergonomic handles and comfort grips are known. US patent publication 2002-0168214 discloses a mascara handle grip made from one or more deformable elastomers and having a dual-tapered portion such that two tapered sections meet at a narrowest point along the dual-tapered portion, and wherein the cross section of one or both tapered sections is elliptical. Another example is U.S. Pat. No. 7,465,114, which discloses a mascara applicator with vibrating applicator head. Like the embodiments of the heating applicator described herein, the vibrating applicator is able to alter the rheological properties of mascara compositions. Thus, vibration may be useful in at least some embodiments of the present invention, to achieve improved results.

B. Mascara Composition

A careful reading shows that the U.S. Pat. No. 7,083,347, U.S. Pat. No. 7,090,420, US 2005/0031656 and US2005/0013838 references are concerned with the problem of curling eyelashes immediately before, during or immediately after applying mascara. It may be for this reason that the melting peak, mid-height width is limited to 20° C. or less. The patents allege that these peaks are sufficiently narrow to ensure fast cooling (i.e. "within the time period of a few seconds") of the previously heated mascara, and a fast return to the crystalline or higher viscosity state. This type of mascara composition will be referred to as "fast setting". In contrast, these references may suggest not to use heating applicators with compositions that require substantially more than a "few seconds" to set up, say at least 5, 10 or 15 seconds to set up. This type of mascara composition will be referred to as "slow setting". Fast setting compositions may be problematic when used with a heating applicator, because mascara application and grooming typically requires more than "a few seconds" to complete. A user typically wants more than just curled lashes. A user also wants an improvement in some or all of the performance characteristics defined above, or at least a "do no harm outcome". It is generally understood in the art, that the more times the making up procedure is repeated, the more chance there is to mess up the entire application of mascara, even with a non-heated applicator. The longer it takes to perform the application, the more complicated it becomes. If the product already applied to the lashes is setting up and drying out while new mascara is still being applied over it, an even, clean appearance may be very difficult to achieve, and various of the performance characteristics defined above are bound to suffer. This is because while the user is attempting to curl and otherwise groom her lashes, the product on the lash is rapidly hardening, while the product on the brush is in a continuum of physical states in between solid and liquid, due to the wide temperature amplitude (up to 30° C.) caused by the various components in the formula. Thus, while some curling may be locked in by the fast setting nature of the mascara, various of the performance characteristics defined above will almost certainly suffer, as the user struggles with the non-homogenous nature of the product.

Thus, if one is going to use a fast setting mascara, it is advantageous to reduce the application time. Therefore, in one embodiment of the present invention, the applicator is able to withdraw from the reservoir enough product for a complete application to a single set of eyelashes, to avoid, having to reinsert the applicator multiple times. On the other hand, even if a user reinserts the brush for more product, then it is preferable in some embodiments if the heated applicator is able to heat the fast-setting mascara very quickly, so that the product already on the lashes may not dry out fully before applying a second coat. Therefore, mascara products that have melting peaks with a width at mid-height, of less than or equal to 20° C., would clearly benefit from a heated applicator that is able to heat 0.15 g or more of a product from an ambient temperature to a product application temperature, in a maximum amount of time. In another embodiment, a heated applicator is able to heat 0.25 g or more of a product from an ambient temperature to a product application temperature, in a maximum amount of time. In other embodiments the amount of product that my be heated from an ambient temperature to a product application temperature is 0.40 g or more or 0.50 g, in a defined maximum amount of time.

As noted, the '347, '420, '656 and '838 references are concerned with "thermally stable" compositions. However, in realistic use of a heated applicator, a mascara might never be heated to 80° C. for 2 hours. Therefore, these references may suggest little, if anything, about the use of heating applicators as disclosed herein. Also, these references may not suggest anything about compositions that are specifically not "thermally stable" as defined therein. As used herein, "thermally dynamic" formulation means a composition whose viscosity varies by more than 25%, after being subjected to a succession of no fewer than 4 melting/cooling cycles according to the protocol set forth in those references. Unexpectedly, embodiments of the present invention have achieved useful results with "thermally dynamic" compositions.

Embodiments of the present invention include a heated applicator that provides sufficient energy to effectively heat a product with which it comes in contact, to an application temperature, within 25 seconds, preferably within 15 seconds, more preferably within 10 seconds, most preferably within 5 seconds. Higher product application temperatures are achievable if the product remains in contact with the heating applicator for more than 25 seconds, but many advantages for the consumer market are already attained by a fast heat up time of 25 seconds or less. For example, within 25 seconds of heating, the mascara may experience reduced viscosity, with or without melting, such that application and grooming would be appreciably easier. Or, for example, with just 25 seconds or less of heating, the completed mascara application may show an improvement in one or more performance characteristics, such as a 1, 2 or 3 point improvement as defined above. If the product on the applicator or already transferred to the lashes remains in contact with the heating applicator, then the product may continue to heat beyond 25 seconds, in which case additional benefits may be realized.

Embodiments of the present invention specifically include heating applicators for compositions that set more slowly than those contemplated in '347, '420, '656 and '838 (i.e. that require more than a few seconds to set) and/or compositions that have mid-height widths of greater than 20° C., preferably greater than 25° C., more preferably greater than 30° C., and most preferably greater than 35° C. Also, embodiments of the present invention specifically include heated applicators for compositions that may not be thermally stable as defined therein. These are all outside the purview of '347, '420, '656 and '838. At the same time, embodiments of the heated applicator described herein, improve the application of "fast-setting" mascaras. Thus, embodiments of the present invention significantly enhance the types of formulations that may be offered to consumers, and offers benefits in manufacture and cost of production.

Therefore, some embodiments disclosed herein, are fast-setting and slow-setting mascara compositions for use with a handheld heating applicator, but especially embodiments of slow-setting compositions that have a cooling set time of greater than about 5 seconds, preferably greater than 10 seconds, more preferably greater than 15 seconds. Also disclosed are embodiments of mascara compositions that benefit from being softened by a handheld heated applicator, without being melted, as well as those that may melt. Also disclosed are embodiments of mascara compositions that benefit from being heated by a handheld heating applicator in 25 seconds or less. Also disclosed are embodiments of mascaras that are not thermally stable (as that term is defined in U.S. Pat. No. 7,083,347, U.S. Pat. No. 7,090,420, US 2005/0031656 and US2005/0013838), and yet benefit from use with our handheld heated applicator.

In general, any mascara composition may be used with the heated applicator of FIG. 1. In particular, the thermally stable, fast-setting compositions of U.S. Pat. No. 7,083,347, U.S. Pat. No. 7,090,420, US 2005/0031656 and US2005/0013838 may be particularly improved. For example, the application of a fast setting mascara would, in general, be improved by a fast heat up applicator that holds a pre-defined peak temperature within a narrow fluctuation, while grooming the lashes. The fast heat up and consistent output will tend to ensure that the formulation remains pliable during application, and does not appreciably set before the application is finished. As another example, the application of a "thermally stable" mascara would, in general, be improved by a fast heat up applicator that holds a pre-defined peak temperature within a narrow fluctuation, while grooming the lashes.

An example of a mascara that is "slow-setting" and not "thermally stable", but which is also suitable for use with a handheld, heated applicator of FIG. 1, is as follows.

| CTFA Name | Percent by weight |
|---|---|
| Water | qs |
| Simethicone | 0.10 |
| Iron oxides | 8.00 |
| PVP K-30 powder | 1.00 |
| Hydroxypropyl methylcellulose | 0.50 |
| VP/Polycarbamyl/Polyglycol ester | 2.00 |
| Pantethine | 0.10 |
| Panthenol | 0.10 |
| Disodium EDTA | 0.05 |
| Tetrasodium EDTA | 0.10 |
| Sucrose stearate | 0.80 |
| Aminomethyl propanediol | 1.20 |
| Methyl paraben | 0.35 |
| Talc | 3.00 |
| Nylon fiber | 1.00 |
| Stearic acid | 3.00 |
| Acetylated sucrose distearate | 3.30 |
| Beeswax | 7.90 |
| Ozokerite | 8.00 |
| Glyceryl stearate | 5.50 |
| Sorbitan sesquioleate | 0.80 |
| Butyl paraben | 0.15 |
| Propyl paraben | 0.15 |
| Water/Acrylates copolymer/butylene glycol/sodium laureth sulfate | 7.00 |
| HDI/Trimethylol hexyllactone crosspolymer//silica | 2.00 |
| Water/Hydrolyzed wheat protein/PVP crosspolymer | 0.50 |
| Phenoxyethanol | 0.50 |
| Bisabolol | 0.10 |

This composition has a melting peak width at mid-height of greater than 23° C., and a change in viscosity after 4 heating cycles as described herein, that is greater than 25%.

In one embodiment of the present invention, using a single battery nominally rated for 3 volts at 1,400 mAmp-hours, the following heat up data for this formulation was measured using a FLIR A320 thermal camera.

| Heat-up time (seconds) | Surface temperature of product (° C.) |
|---|---|
| 0 | 21.5 |
| 5 | 22.8 |
| 10 | 25.9 |
| 15 | 28.9 |
| 25 | 34.0 |

It should be noted that, in this example, the product temperature at a time t=0 is 21.5° C. The product reaches 34° C. in about 25 seconds. That is a heat up of 12.5° C. of the product, in twenty five seconds. The product on the applicator head continued to heat up beyond 25 seconds, reaching about 42° C. at about 60 seconds, at which time, in this particular test, the brush was immersed again into the product reservoir, simulating an actual use. The brush was withdrawn from the reservoir, at which time the product on the brush measured about 24° C. However, the product then began to heat up again, at an accelerated rate, re-establishing 42° C. within about 15 seconds of being removed from the reservoir. The product continued to heat to over 60° C., in about 150 seconds. On the two parts of the heat up curve, the data fits an approximate straight line, which means that heat up of the product commences as soon as the power is turned on and proceeds at a steady rate.

What we claim is:

1. A handheld mascara applicator comprising an applicator head that has an outer surface, a source of electric current, and a heat generating portion, wherein bristles are located on a portion of the outer surface of the applicator head, and wherein the heat generating portion comprises a plurality of discrete, fixed value resistive heating elements, located underneath the portion of the outer surface that has bristles, and wherein the heat generating portion is effective to heat at least 0.15 g of mascara located on the outer surface of the applicator head, from an ambient temperature to a product application temperature, in 25 seconds or less, measured from the moment the heat generating portion is activated.

2. The applicator of claim 1, wherein ambient temperature is from 20° C. to 25° C. and product application temperature is 30° C. or greater.

3. The applicator of claim 2, wherein ambient temperature is from 20° C. to 25° C. and product application temperature is 35° C. or greater.

4. The applicator of claim 1 that is able to heat at least 0.25 g of mascara located on the applicator head, from 20° C. to 25° C. to 35° C. or greater, in 25 seconds or less.

5. The applicator of claim 1 wherein the bristles and the heating elements, each have a non-random, linear distribution along the central, longitudinal axis of the applicator head.

6. The applicator of claim 5 wherein the linear distributions of bristles and heating elements along the central, longitudinal axis are constant.

7. The applicator of claim 5 wherein the linear distributions of bristles and heating elements along the central, longitudinal axis are not constant.

8. The applicator of claim 5 wherein the bristles are arranged in rows or turns about the central, longitudinal axis, and the ratio of the number of heating elements to the number of rows or turns of bristles is 1:1 or more.

9. The applicator of claim 5 wherein the number of heating elements is 1 or more, per 2 mm of central, longitudinal axis length.

10. The applicator of claim 5 wherein the ratio of heating elements to bristles is from 1:30 to 1:60 or more.

11. The applicator of claim 10 having from 100 to 300 bristles and from 16 to 40 heating elements.

12. The applicator of claim 1 wherein at least some of the heating elements are arranged in a parallel electric circuit.

13. The applicator of claim 1 wherein the heat generating portion is supported by a printed circuit board that comprises a substrate that is non-conductive to electricity, and that supports electronic components and electrical leads that are effective to connect the heat generating portion to the source of electric current.

14. The applicator of claim 13 further comprising at least one on/off switch.

15. The applicator of claim 14 that automatically turns off the heat generating portion after 2 to 3 minutes of use.

16. The applicator of claim 13 wherein the applicator head is a molded brush that comprises a hollow, elastomeric sleeve that fits over a distal end of the printed circuit board, so that the heating elements on the printed circuit board (8) are in direct contact with an inner surface of the hollow sleeve.

17. The applicator of claim 16 wherein the heating elements are embedded in a continuous, solid mass of a heat transfer material.

18. The applicator of claim 17 wherein the heat transfer material is one or more thermally conductive adhesives, one or more thermally conductive encapsulating epoxies or a combination of these.

19. The applicator of claim 16 wherein the sleeve comprises one or more thermoplastic elastomers.

20. The applicator of claim 19 wherein the sleeve has a thickness of less than 1.0 mm.

21. The applicator of claim 20 wherein the sleeve has a thickness of less than 0.4 mm.

22. The applicator of claim 19 wherein the thermoplastic elastomer has a Shore D hardness of 47 to 55.

23. The applicator of claim 16 wherein the applicator head further comprises one or more thermochromic materials.

24. The applicator of claim 13 wherein the heating elements are a bank of fixed value resistors electronically arranged in series, parallel, or any combination thereof, and physically situated in two rows, one on both sides of the printed circuit board.

25. The applicator of claim 24 wherein the fixed value resistors have rated resistances from 1 to 10 ohms.

26. The applicator of claim 25 wherein the overall resistance of all the heating elements ranges from 1 to 10 ohms.

27. The applicator of claim 24 wherein the resistive heating elements are metal oxide thick film, chip resistors, the largest dimension of which is 2.0 mm or less.

28. The applicator of claim 24 wherein the resistive heating elements are discrete dots of a metal oxide thick film, provided as a silk screen deposit on the printed circuit board.

29. The applicator of claim 28 metal oxide thick film is comprised of ruthenium oxide ($RuO_2$), and each dot is 2.0 mm or less.

30. The applicator of claim 13 further comprising a handle that houses the source of electric current, and wherein the source of electric current is a battery that has a terminal that directly contacts a conductive element on the printed circuit board.

31. The applicator of claim 30 wherein the battery is a 2.5 to 3.5 volt battery, having a capacity of 1,400 mAmp-hours or more.

32. The applicator of claim 31 wherein the battery is based on lithium/manganese dioxide chemistry and having no mercury.

33. The applicator of claim 30, wherein the battery is replaceable through a removable cap in the handle.

34. The applicator of claim 33, wherein the battery is rechargeable.

35. The applicator of claim 13 wherein the temperature of the outer surface of the applicator head reaches a leveling off temperature of from 30° C. to 90° C., after which time the temperature of the surface is maintained within ±2° C. of the leveling off temperature.

36. The applicator of claim 35 which includes a voltage divider circuit and a thermistor.

37. The applicator of claim 35 which further comprises an operational amplifier and an N-channel MOSFET switch.

38. The applicator of claim 14 wherein at least one on/off switch is accessible from the outside the applicator that can be engaged, either directly or indirectly, by a finger of the user.

39. The applicator of claim 14 wherein at least one on/off switch operates to activate the heating elements when the applicator is drawn from a container, and deactivated when the applicator is reinserted into the container.

40. The applicator of claim 30 further comprising a stem, which is a hollow, elongated member, having a proximal end that is fitted to the handle, and through which the printed circuit board is reposed.

41. A system for applying a mascara composition, the system comprising:

a container;

a mascara composition contained in the container, wherein the mascara composition has a thermal profile that has a mid-height, melting peak width of more than 20° C.; and a handheld mascara applicator according to claim 1.

42. The system of claim 41 wherein the mascara composition is thermally dynamic.

43. A system for applying a mascara composition, the system comprising:

a container;

a mascara composition contained in the container, wherein the mascara composition has a cooling set time of more than about 10 seconds; and a handheld mascara applicator according to claim 1.

44. A system for applying a mascara composition, the system comprising:

a container;

a thermally dynamic mascara composition contained in the container; and a handheld mascara applicator according to claim 1.

* * * * *